US008636327B2

(12) United States Patent
Penner et al.

(10) Patent No.: US 8,636,327 B2
(45) Date of Patent: Jan. 28, 2014

(54) STORAGE CHEST FOR TOOLS OR THE LIKE

(75) Inventors: Marvin Penner, Arborg (CA); Norman Penner, Arborg (CA); Abe Penner, Arborg (CA)

(73) Assignee: OKNO Manufacturing Inc., Arborg, Manitoba (CA)

( * ) Notice: Subject to any disclaimer, the term of this patent is extended or adjusted under 35 U.S.C. 154(b) by 0 days.

(21) Appl. No.: 13/446,582

(22) Filed: Apr. 13, 2012

(65) Prior Publication Data

US 2012/0194051 A1 Aug. 2, 2012

Related U.S. Application Data

(62) Division of application No. 12/559,200, filed on Sep. 14, 2009.

(51) Int. Cl.
*E05B 65/46* (2006.01)

(52) U.S. Cl.
USPC ..... 312/219; 312/305; 280/43.17

(58) Field of Classification Search
USPC ..... 312/219, 217, 216, 266, 249.2, 305, 312/351.11, 351.13, 319.9, 249.8, 249.11, 312/351.1; 280/43, 43.14, 43.17, 43.24, 39, 280/43.13, 43.15, 47.17, 641; 16/35 R, 32, 16/33; 248/129; 220/23.4, 23.6
See application file for complete search history.

(56) References Cited

U.S. PATENT DOCUMENTS

| | | | | | |
|---|---|---|---|---|---|
| 589,463 | A * | 9/1897 | Case | 312/326 |
| 2,239,734 | A * | 4/1941 | Pratt | 312/238 |
| 2,663,608 | A * | 12/1953 | Schauer | 312/326 |
| 2,800,382 | A * | 7/1957 | Engstrom | 312/305 |
| 2,841,410 | A * | 7/1958 | Kessler, Jr et al. | 280/43.15 |
| 2,857,232 | A * | 10/1958 | Manne | 312/329 |
| 3,154,317 | A * | 10/1964 | Gustafsson | 280/104 |
| 4,146,280 | A * | 3/1979 | Crownhart | 312/305 |
| 4,250,666 | A * | 2/1981 | Rakestraw | 47/83 |
| 4,274,644 | A * | 6/1981 | Taylor | 280/39 |
| 4,639,051 | A * | 1/1987 | DeBruyn | 312/275 |
| 4,738,495 | A * | 4/1988 | Mitts | 312/305 |
| 4,971,234 | A * | 11/1990 | Hay | 224/42.32 |
| 4,978,023 | A * | 12/1990 | Behlmann et al. | 220/23.6 |
| 5,348,326 | A * | 9/1994 | Fullenkamp et al. | 280/43.17 |
| 5,403,022 | A * | 4/1995 | Snider | 280/30 |
| 5,516,203 | A * | 5/1996 | Branham et al. | 312/324 |
| 6,206,210 | B1 * | 3/2001 | Reed | 211/96 |
| 7,201,385 | B2 * | 4/2007 | Renz et al. | 280/79.11 |
| 7,278,644 | B2 * | 10/2007 | Villarreal | 280/47.26 |
| 7,641,235 | B1 * | 1/2010 | Anduss | 280/769 |

(Continued)

*Primary Examiner* — Darnell Jayne
*Assistant Examiner* — Hiwot Tefera
(74) *Attorney, Agent, or Firm* — Kyle R. Satterthwaile; Ryan W. Dupuis; Ade & Company Inc.

(57) ABSTRACT

Storage chests for tools or the like feature swiveling drawers pivotally mounted to avoid jamming due to misalignment in use of a sliding drawer. The chests employ unique locking systems tailored for use with such pivoting drawers, where an actuator is operable to pivot a blocking member inside the chest between the drawers and a wall of the surrounding housing about a vertical axis into a position interfering with motion of a feature projecting outward from one or more drawers under attempted pivoting thereof. Some embodiments feature a wheel deployment system operable to give a user control over when to rollably support the chest or have it stand on stationary legs, for example for use of the top surface of the chest as a work surface.

11 Claims, 18 Drawing Sheets

(56) References Cited

U.S. PATENT DOCUMENTS 7,909,074 B2 * 3/2011 Yu ..... 144/286.5
2008/0297016 A1 * 12/2008 Hsieh ..... 312/249.2
2009/0174162 A1 * 7/2009 Gass et al. ..... 280/79.11
2010/0140889 A1 * 6/2010 Chang ..... 280/47.34

* cited by examiner

STORAGE CHEST FOR TOOLS OR THE LIKE

CROSS REFERENCE TO RELATED APPLICATIONS

This application is a divisional of U.S. Non-provisional patent application Ser. No. 12/559,200, filed Apr. 14, 2009.

FIELD OF THE INVENTION

The present invention relates generally to storage chests featuring drawers for the storage of tools or other items, and more particularly to storage chests employing lockable swivel-mounted drawers and a selectively deployable wheel system allowing easy transport between different locations where the wheels can then be retracted upward to re-stand the chest on its support legs for stationary use.

BACKGROUND OF THE INVENTION

Tool chests used to store tools and small equipment in such places as homes, residential garages or workshops, commercial automotive repair facilities and manufacturing environments conventionally feature frames or housings of metal construction that support vertical columns of metal drawers that are slidably or rollably supported by way of cooperating rails and roller elements at the sides of the drawers. Such conventional drawer arrangements can be troublesome in that attempts to close a drawer when slightly out of angular alignment with its intended linear travel path along the rails can result in jamming of the drawer. This can especially be experienced when heavy tools or other objects produce an uneven weight distribution on the bottom of the drawer, which may tend to induce the misalignment of the drawer with the frame or wall-mounted rails of the frame or housing of the chest.

It is known in the prior art to provide a combination tool chest and workbench by providing the frame or housing in which the tool storage drawers with a significantly rigid structure to support a cover with a table top or counter like structure providing a horizontal work surface on which various equipment may be placed or mounted and a variety of tasks may be performed. However, conventional workbench frames are typically equipped with legs so that the workbench stands stationary as rigidly as possible so as not to move while being used, especially since the type of operations (assembly, cutting, drilling, fastening, etc.) typically carried out on a workbench surface require a steady fixed support for the object being worked on or equipment being used in the process. This contradicts what is typically considered an advantageous aspect of portable tool chests that are conventionally equipped with wheels to allow easy transport from one location to another. Accordingly, there is a desire for storage chests that overcome the shortcomings of conventional sliding drawer chests and can provide stability for stationary use while retaining a significant level of portability.

SUMMARY OF THE INVENTION

According to a first aspect of the invention there is provided a storage chest comprising:

a frame comprising a base, a frame wall structure projecting upward from the base, a cover disposed atop the frame wall structure and a doorless open face left between the base and cover between sections of the frame wall structure; and at least one drawer carried on the frame between the base and the cover thereof, each drawer comprising a bottom drawer wall and a plurality of upright drawer walls projecting upward from the bottom drawer wall toward an opposing top end of the drawer and forming boundaries of a storage space area atop the bottom drawer wall; and each drawer being pivotally supported on the base of the frame and pivotable about a respective upright axis projecting upward from the base between a closed position, in which a front face of the drawer defined by a front drawer wall of the upright drawer walls aligns with the open face of the frame to situate the storage space are of the drawer behind the open face of the frame between sections of the frame wall structure, and an open position, in which the storage space of the drawer is situated at least partly in front of the open face of the frame outward from between the sections of the frame wall structure;

the at least one drawer substantially closing off the doorless open face of the frame when in the closed position.

The frame wall structure may comprise a pair of side frame walls having ends situated adjacent opposite sides of the open face of the frame and, for each one of the drawers, the drawer being pivotally supported on the frame adjacent a respective side of the open face and the side frame wall opposite said respective side of the open face extending away from said respective side of the open face where said side frame wall connects to the other side frame wall. In this instance, preferably the upright drawer walls of each drawer comprise a side drawer wall disposed adjacent and parallel to the side frame wall opposite the respective side of the open face adjacent which said drawer is pivotally supported.

The frame wall structure may comprises a pair of side frame walls having ends situated adjacent opposite sides of the open face of the frame and diverging toward the open face from where the side frame walls are connected. In this instance, preferably the upright drawer walls of each drawer comprise a pair of side drawer walls disposed on opposite sides of the storage space area of the drawer and diverging toward the front face of the drawer at an angle corresponding to that by which the side frame walls diverge toward the open face of the frame, each drawer being pivotally mounted to the frame adjacent one of the opposite sides of the open face of the frame.

The upright drawer walls of each drawer may comprise a side drawer wall extending away from the front drawer wall where the drawer is pivotally supported, and a connecting drawer wall section extending along a path curving about the upright axis about which the drawer is pivotal in a connection between the front drawer wall and the side drawer wall, the connecting wall section being disposed on a side of where the drawer is pivotally supported having a lesser angular spacing between the front drawer wall and the side drawer wall about the upright axis than an opposite side of where the drawer is pivotally supported. In this instance, the at least one drawer may comprise at least one pair of drawers disposed side by side in the open face of the frame when each in the closed position, with the drawers of each pair of drawers preferably being pivotally supported adjacent opposite sides of the open face of the frame with the connecting drawer wall sections of the pair of drawers facing one another with the pair of drawers each in the closed position.

Preferably one or more of the at least one drawer is lockable in the closed position by a locking mechanism carried on the frame.

Preferably the locking mechanism comprises a blocking member movably supported on the frame adjacent one of the sections of the frame wall structure and movable into and out of a locking position cooperating with a projecting feature projecting outward from one of the upright drawer walls to block pivotal movement of the drawer out of the closed position into the open position.

Preferably the blocking member is pivotal into and out of the locking position about an upright lock axis.

Preferably the at least one drawer consists of a plurality drawers disposed one over another to define a column of vertically spaced drawers in the open face of the frame when each in the closed position and the blocking member is elongated in an upright direction to block pivoting of more than one of the plurality of drawers in the column out of the closed position thereof when in the locking position.

Preferably the blocking member comprises a plate pivotally supported on the frame adjacent the one of the sections of the frame wall structure and pivotal into and out of the locking position, in which the plate projects further from said one of the sections of the frame wall structure than when not in the locking position.

There may be provided a set of legs depending downward from the base and a set of wheels carried on the frame and movable into and out of deployed positions extending further downward from the base than the legs to rollably support the storage chest on the ground when deployed.

This selectively deployment of wheels is preferably provided by:

interconnected lengths of shaft pivotally secured to the frame adjacent opposite peripheral portions thereof below the at least one drawer and proximate the base of the frame, the lengths of shaft being pivotal together about a longitudinal pivot axis extending across the frame and centrally and longitudinally through the lengths of shaft;

movable wheel supports supported on the frame below the at least one drawer and proximate the base of the frame, the movable wheel supports each being pivotal about a respective transverse pivot axis crossing the longitudinal pivot axis to allow upward and downward movement of a free end of the wheel support at a distance from the respective transverse pivot axis along the longitudinal pivot axis, the wheels being mounted on the movable wheel supports adjacent the free ends thereof;

eccentric elements eccentrically carried on the lengths of shaft to revolve about the longitudinal pivot axis under pivoting thereof; and links each pivotally connected at opposite ends thereof to a respective one of the eccentric elements and a respective one of the movable wheel supports at a respective position along the longitudinal pivot axis between the transverse pivot axis of the respective movable wheel support and the free end thereof such that pivoting of the lengths of shaft in opposite directions to move the eccentric elements together into and out of a predetermined angular position about the longitudinal pivot axis moves the free ends of the movable wheel supports downward and upward respectively to move the wheels into and out of the deployed positions.

Preferably at least one of the lengths of shaft projects outwardly from the frame and has a lever fixed to the length of shaft outward from the frame for user control of pivoting of the lengths of shaft.

Preferably the wheels automatically lock in the deployed position and only retract therefrom under input from an operator.

Preferably the wheel deployment arrangement includes a stop at a fixed position on the frame cooperative with a feature on one of the shaft lengths to block further pivoting of the lengths of shaft after having reached a point where the eccentric elements have moved over center about the longitudinal pivot axis and reached the predetermined angular position between under and over center positions thereabout.

According to a second aspect of the invention there is provided a storage chest comprising:

a frame comprising a base, an upright structure projecting upward from the base, a cover disposed atop the upright structure and an open face left between the base and the cover; and at least one drawer carried on the frame between the base and the cover thereof, each drawer comprising a bottom drawer wall and a plurality of upright drawer walls projecting upward from the bottom drawer wall toward an opposing top end of the drawer and forming boundaries of a storage space area atop the bottom drawer wall; and each drawer being pivotally supported on the base of the frame and pivotable about a respective upright axis projecting upward from the base between a closed position, in which a front face of the drawer defined by a front drawer wall of the upright drawer walls aligns with the open face of the frame to situate the storage space area of the drawer inside the frame behind the open face thereof, and an open position, in which the storage space of the drawer is situated at least partly outside the frame in front of the open face thereof;

the at least one drawer substantially closing off the open face of the frame when in the closed position; and a locking mechanism carried on the frame an operable to lock one or more of the at least one drawer in the closed position.

According to a third aspect of the invention there is provided a storage chest comprising:

a frame comprising a base, an upright structure projecting upward from the base, a cover disposed atop the upright structure and an open face left between the base and the cover;

at least one drawer carried on the frame between the base and the cover thereof, each drawer comprising a bottom drawer wall and a plurality of upright drawer walls projecting upward from the bottom drawer wall toward an opposing top end of the drawer and forming boundaries of a storage space area atop the bottom drawer wall; and each drawer being movably supported on the base of the frame and movable between a closed position, in which a front face of the drawer defined by a front drawer wall of the upright drawer walls aligns with the open face of the frame to situate the storage space area of the drawer inside the frame behind the open face thereof, and an open position, in which the storage space of the drawer is situated at least partly outside the frame in front of the open face thereof;

a set of legs depending downward from the base of the frame;

a set of wheels carried on the frame and movable into and out of deployed positions extending further downward from the base than the legs to rollably support the storage chest on the ground when deployed, the set of wheels being arranged to automatically lock in place when deployed into the deployed positions.

BRIEF DESCRIPTION OF THE DRAWINGS

In the accompanying drawings, which illustrate exemplary embodiments of the present invention.

DETAILED DESCRIPTION

Figure 1:
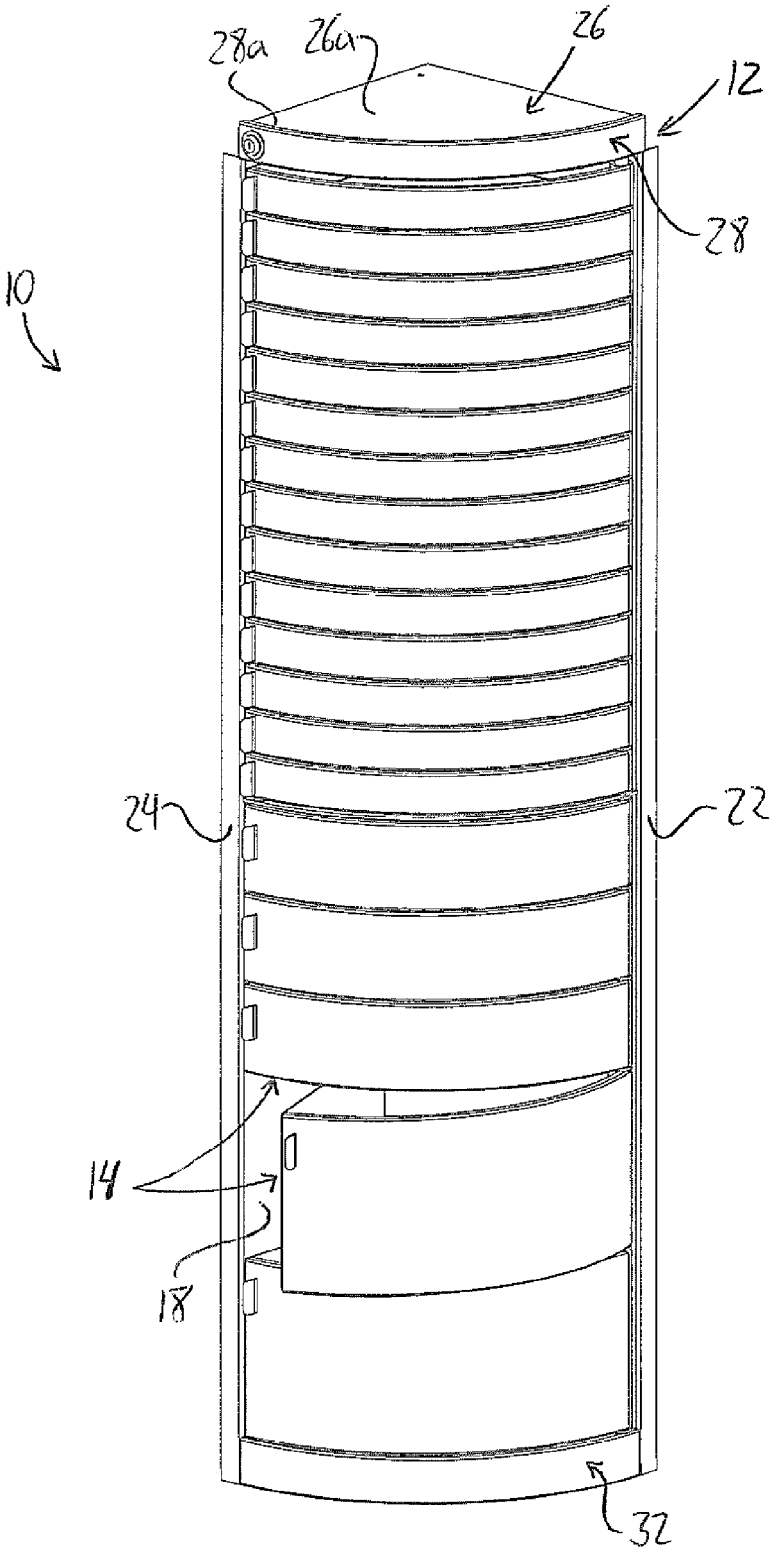
FIG. 1 is a front isometric view of a tool chest according to a first embodiment of the present invention.

FIG. 1 shows a first embodiment tool chest 10 of the present invention having a frame or housing 12 containing a single column or vertical row of drawers 14 that are each individually pivotally mounted on the frame 12 in a hinge-like manner so as to swivel about a vertical axis into and out of the interior space of the tool chest defined between the housing walls, thereby avoiding the aforementioned drawbacks of conventional sliding drawers.

The chest 10 features a pair of diverging planar side walls 16, 18 meeting one another to define a rear corner edge 20 of the chest 10. The vertical side walls 16, 18 diverge at ninety degrees to one another so that the rear corner 20 of the chest is a right angle suitable for fitting into the corner of a conventional rectangular room. The side walls may be formed from a single integral sheet of material, such as a metal sheet or plate bent to form the rear corner edge 20. In the illustrated chest, the ends of the side walls 16, 18 feature integral flanges 22, 24 formed by bending of the planar walls at ends thereof opposite the rear corner 20 to project outwardly away from the respective side walls 16, 18 at right angles thereto.

Figure 2:
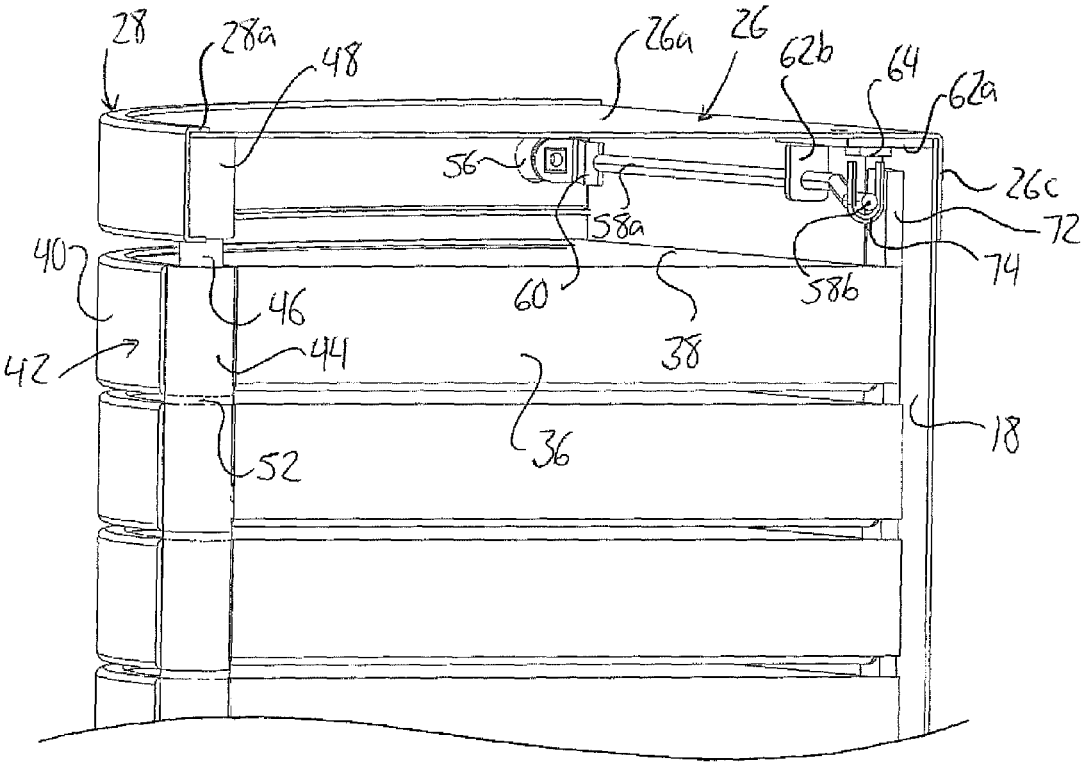
FIG. 2 is a partial rear, right side isometric view of the first embodiment tool chest with a right rear side panel thereof cut away.
Figure 3:
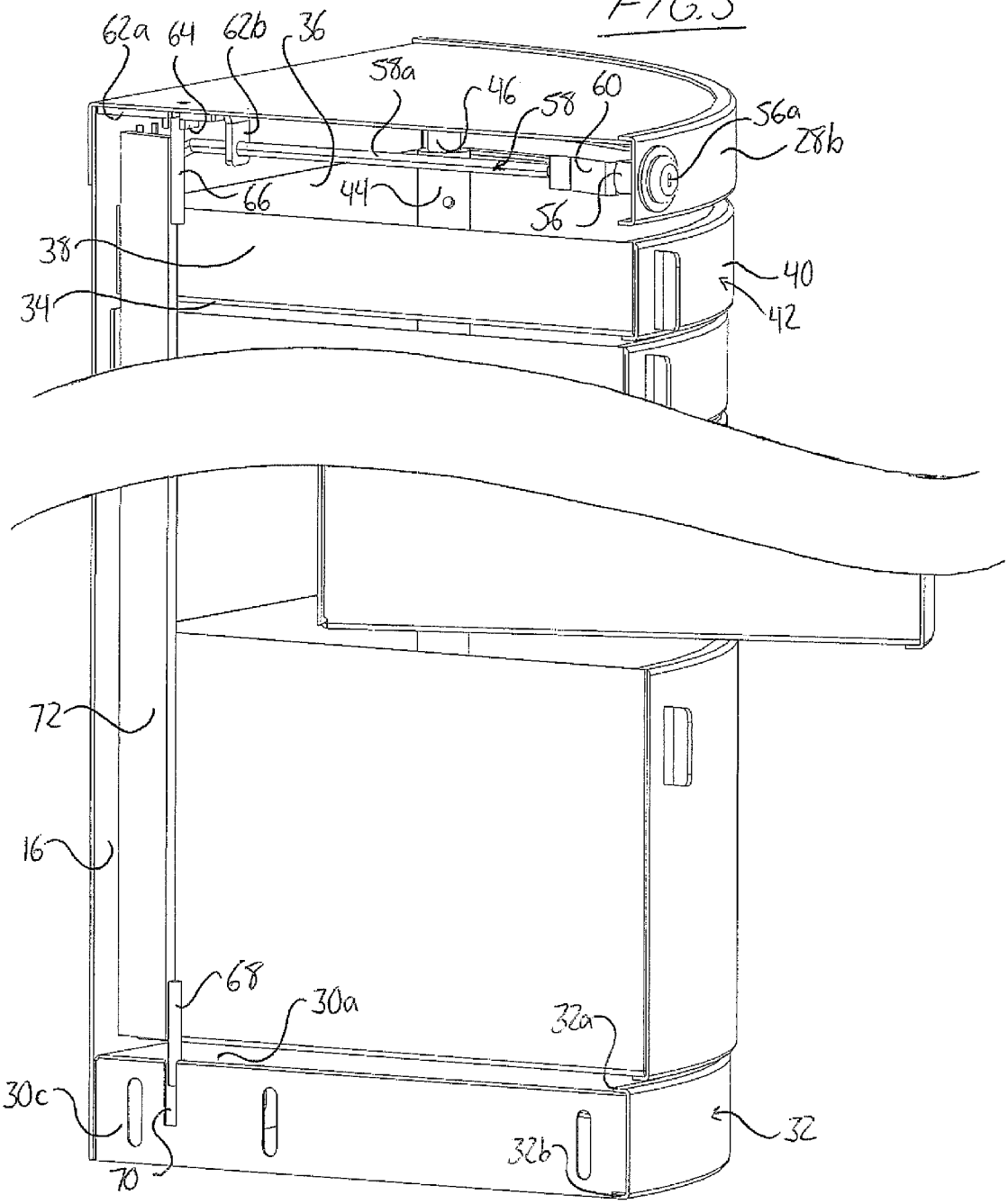
FIG. 3 is a top, rear, left side isometric view of the first embodiment tool chest with a left rear side panel thereof cut away

A cover 26 has a cap-like structure fitted over the side walls 16, 18 at the top ends thereof, presenting a planar horizontal top panel 26*a* spanning the area between the side walls and two vertical flanges 26*b*, 26*c* depending downward from the top panel 26*a* and seated against the outer planar faces of the side walls 16, 18. The flanges 22, 24 of the side walls 16, 18 extend from the bottom of the side walls upward, but stop a short distance below the top ends of the side walls. At these unflanged upper end portions of the side walls 16, 18, a top cross member 28 extends horizontally between the side walls 16, 18, curving arcuately about a vertical axis along its horizontal path. As shown in FIGS. 2 and 3, the top cross member 28 has a squared-off C-shaped cross section presenting a top horizontal flange 28*a* projecting inward over the top panel 26*a* of the cover 26 a short distance from the top panel's arcuate front edge following the top cross member's arcuate shape in plan.

Figure 4:
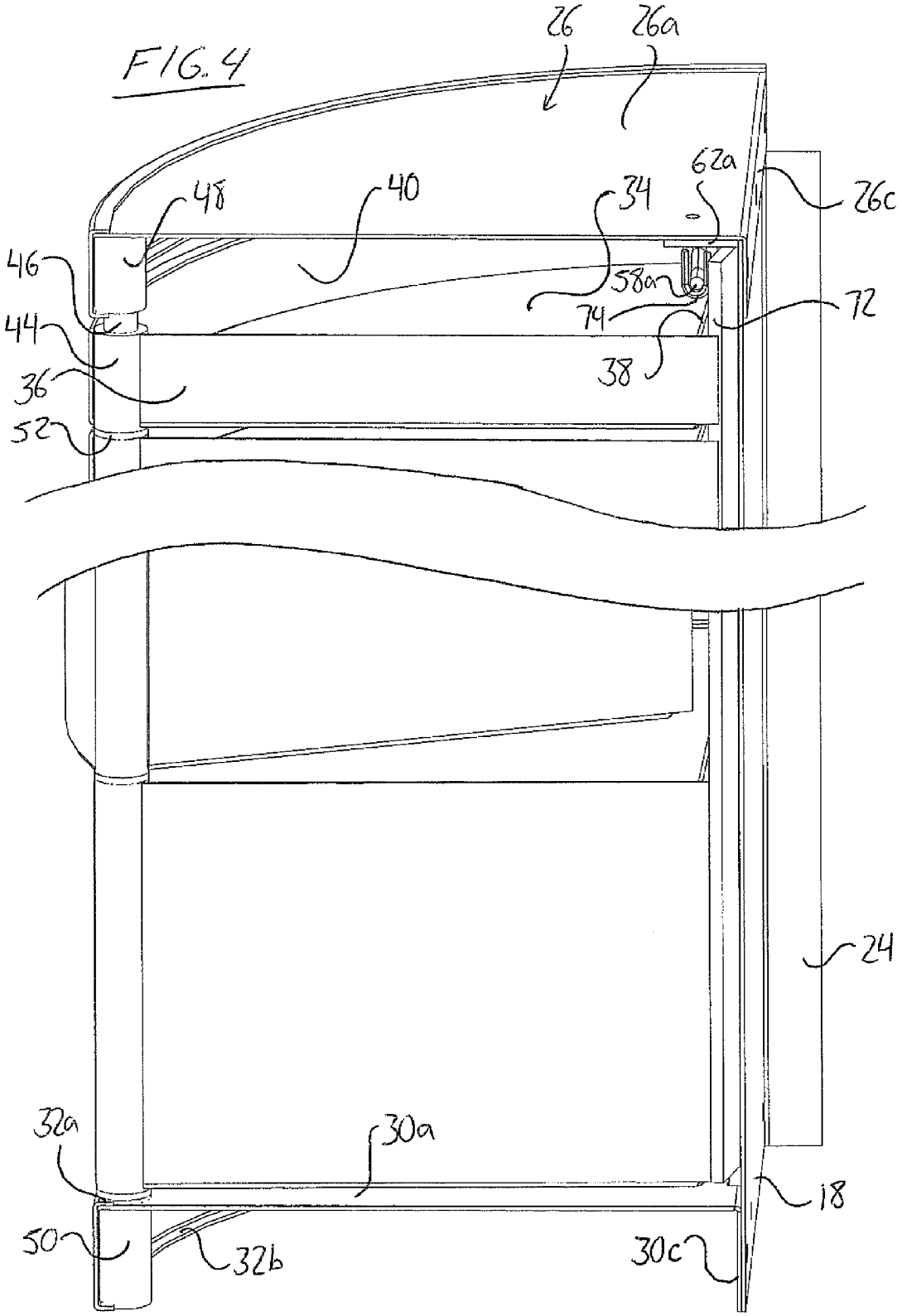
FIG. 4 is a top, rear, right side isometric view of the first embodiment tool chest with the right rear side panel thereof cut away.
Figure 5:
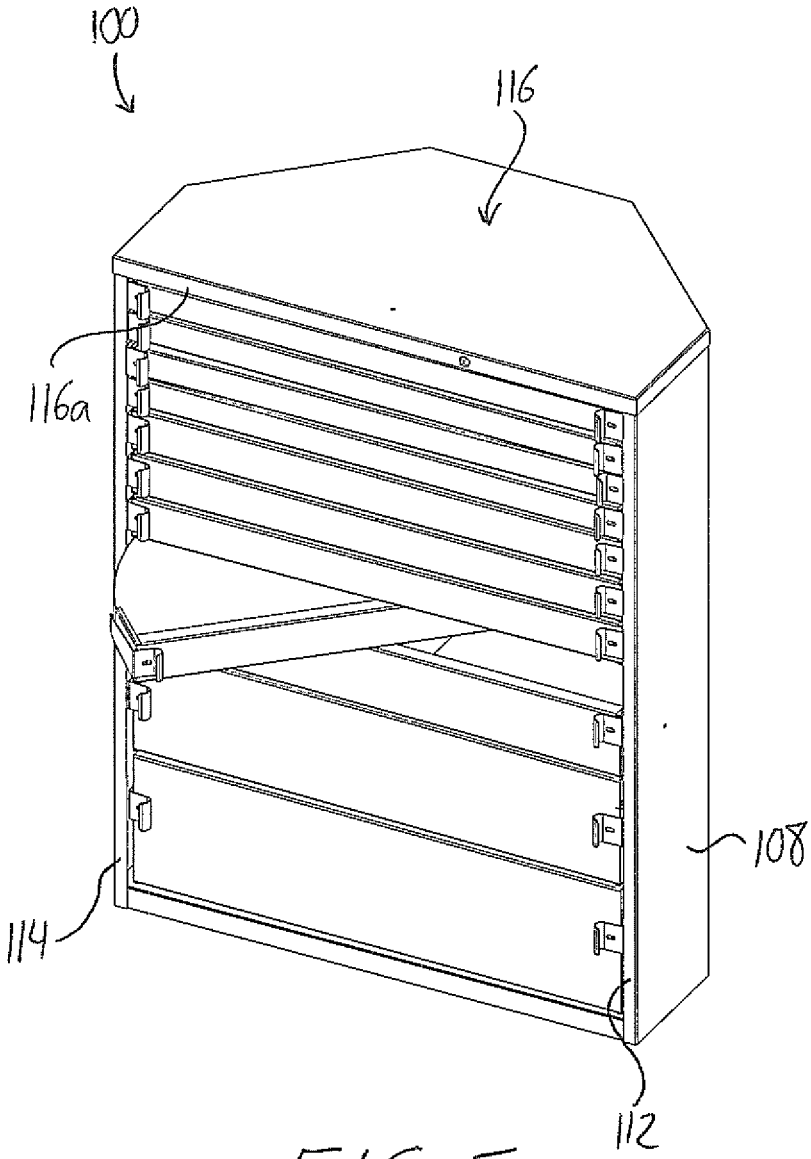
FIG. 5 is a top, front, right side isometric view of a tool chest according to a second embodiment of the present invention.

With reference to FIGS. 3 and 4, a base 30 of the frame 12 has basically the same structure as the cap, with a bottom planar horizontal panel 30*a* spanning the horizontal area between the side walls and two vertical flanges 30*b*, 30*c* depending downward from the bottom panel 30*a*, but is slightly smaller in dimension, with the flanges 30*b*, 30*c* seated against the inner planar faces of the side walls 16, 18. A bottom cross member 32 has the same shape as the top cross member, with a top horizontal flange 32*a* of the member projecting inward over the bottom panel 30*a* of the base 30 a short distance from the bottom panel's arcuate front edge following the bottom cross member's arcuate shape in plan. As shown for one side of the base in FIG. 3, the end of each of the base's vertical side flanges 30*b*, 30*c* opposite the rear corner edge of the chest is notched out at the bottom of the flange to accept the bottom horizontal flange 32*b* of the bottom cross member 32, so that the bottom face of this bottom flange is coplanar with the bottom edges of the base flanges 30*b*, 30*c* and the side walls 16, 18 so as to seat the chest atop a suitable horizontal surface.

The flanges 22, 24 of the side walls 16, 18 define opposite sides of an open front face of the chest frame or housing 12 that is bound at the top and bottom by the top and bottom cross members 28, 32. The arcuate-in-plan shape of the cross members gives the front face of the chest an outwardly convex curved shape, the overall chest thus being sector-shaped when viewed in plan, with the exception of the side wall flanges 22, 24 projecting laterally outward at the front of the chest.

As best shown in FIGS. 3 and 4, each drawer 12 of the chest has a horizontal planar bottom 34 and two side walls 36, 38 and a front wall 40 projecting vertically upward from the bottom 34 of the drawer. The drawer bottom 34 is shaped similarly to the horizontal panels 26*a*, 30*a* of the cover 26 and base 30, but slightly smaller so as to fit within the interior space of the chest between the side walls 16, 18 and the open front face of the frame. The front drawer wall 40 in the first embodiment provided by generally the same structure of the top and bottom cross members of the frame, the vertically projecting front face of the drawer being provided by the vertically oriented center section of the C-shaped cross section of this front member 42 of the drawer. The bottom horizontal flange of the front drawer member 42 seats up against the bottom face of the horizontal drawer bottom 34. In the figures, all but one of the drawers are shown in their closed positions, situating the storage space bound by the side and front walls of the drawer atop the drawer bottom entirely within the interior space of the frame or housing between the side walls 16, 18 and open front face thereof. With the drawer in its closed position, the two side walls 36, 38 of the drawer are disposed parallel to the side walls 16, 18 of the housing a short distance inward therefrom to maximize the storage area of each drawer given the shape of the housing.

Connection of the right side wall 36 of each drawer to the front wall 40 of the drawer is provided by a hollow cylindrical sleeve 44 fixed to the adjacent ends of these two drawer walls and oriented with its longitudinal axis extending vertically so that the interior through-bore of the cylindrical sleeve 44 closes around a vertical shaft 46 projecting from the base 30 to the cover 26 just inside the interior space of the chest adjacent the right side wall 16 thereof. In the figures, top and bottom hollow cylindrical collars 48, 50 are fixed inside the C-shaped cross section of the cover 26 and base 30 to rigidly receive ends of the stationary vertical shaft 46 just below and above the top and bottom panels 26*a*, 30*a* of the cover 26 and base 30 respectively. A top end of each drawer's cylindrical sleeve 44 is flush with the top ends of the drawer's side walls 26, 28, with the sleeve 44 projecting slightly downward below past the drawer bottom 34 to be flush with the bottom face of the bottom flange of the C-channel front member 42 defining the front face of the drawer.

Annular spacers 52 closing about the vertical shaft 46 at spaced positions therealong separate the cylindrical sleeves 44 of vertically adjacent drawers from one another, providing a small vertical space between these each pair of neighbouring drawers. The cylindrical sleeves 44 of the drawers 12 are rotatable about the vertical shaft 46, thereby enabling the horizontal pivoting or swiveling of each drawer about the vertical axis of the shaft 46 for movement of the drawer into and out of the interior space of the chest's frame or housing. The spacers are preferably provided with a friction reducing agent to minimize friction between each drawer and the neighbouring drawer, or in the case of the bottom drawer, between the drawer and the base 30. For example, using Teflon coated washers or spacers will reduce friction between the spacer and each drawer it contacts, thereby helping minimize the tendency of the swinging of one drawer about the vertical shaft axis in an opening direction withdrawing the drawer's storage space substantially out of the chest's interior to also swing a neighbouring drawer outward.

Proximate the end of the front wall 40 of each drawer 20 opposite the end of the front wall where the cylindrical sleeve 44 pivotally supports the drawer on the vertical shaft 46, each drawer features a pull handle 54 projecting outwardly from the front face of the drawer and curving slightly toward the nearest end thereof. Thus, with the drawer in its closed position situating its front face within the open front face of the frame of the storage chest, a user can comfortably reach their fingers in behind the curved outer end of the handle 54 and pull the handle forwardly from the cabinet toward him or herself to pivot the storage area of the drawer at least partially outward from the interior space of the housing for drawer access. Using washer-like spacers of relatively low thickness compared to larger spacers of a more elongated cylindrical shape, vertical spacing between the drawers is minimal so that closing of all the drawers acts to substantially close off the entire open front face of the chest. As in conventional sliding drawer tool chests, this limits the size of the items receivable in each drawer based on the height of the drawer. Accordingly, the first embodiment is shown with drawers of different heights, with a tallest drawer at adjacent the bottom of the chest, a slightly shorter drawer directly above the tallest, a series of equally sized drawers slightly smaller than the last, and finally a series of equal or similarly sized drawers of even lesser height filling a remaining top portion of the chest.

With reference to FIGS. 2 to 4, the chest 10 features a locking mechanism operable to lock and unlock each of the multiple swiveling drawers under operation of a single actuator. A key cylinder 56 is mounted to the top cross member 28 adjacent the left side wall 18 of the frame to present its key slot 56*a* at the outer face of the central vertical portion 28*c* of the cross member's C-shaped vertical cross-section. An elongated lock arm 58 is fixed to the key cylinder 56 by a coupling bracket 60 so that the longitudinal axis of the lock arm 58 aligns with the rotational axis of the key cylinder 56 so that the lock arm 58 rotates with the key cylinder about their concentric axes when a key is used to rotate the key cylinder. A support bracket 62 is fixed to the underside of the top panel 26*a* of the cover 26 at a position adjacent the left side wall 18 between the front and rear ends thereof, nearer the rear end thereof but forward of the rear corner edges of the drawers when the drawers are in their closed positions. The support bracket features a horizontal plate 62*a* fixed flush against the top panel 26*a* and a vertical plate 62*b* depending downward therefrom. A linear portion 58*a* of the lock arm 58 rigidly coupled to the key cylinder 56 passes through a hole in the vertical plate 62*b*, so that the support bracket 62 cooperates with the key cylinder 56 to horizontally support the lock arm 58.

Referring to FIG. 3, at a position on the horizontal support plate 62*a* rearward from the vertical support plate 62*b* and nearer the left side wall 18 than the vertical support plate 62*b*, a support block 64 is provided on the bottom face of the horizontal support plate 62*a* and rotatably receives the upper end of a vertically oriented top pivot shaft or pin 66 in a U-shaped notch that extends into the support block 64 and is closed off by the left side wall 18. A bottom vertical pivot shaft or pin 68 concentric with the top pivot shaft 66 is rotatably received in a slot-like opening 70 that extends into the bottom panel 30*a* and left side flange 30*c* of the base 30 and is also closed off the left side wall 18 to secure the pivot shaft in place. A lock plate 72 having a narrow strip-like rectangular shape is rigidly fixed at its opposite ends to the top and bottom pivot shafts 66, 68 in order to extend its elongated shape vertically therebetween, with the relatively narrow width of the lock plate 72 projecting radially outward from the two vertical pivot shafts 66, 68. Although not shown in figures, a support block is fixed to the underside of the bottom plate 30*a* beneath the opening 70 therein and features a vertical blind-hole extending into the block from above to rotatably receive the bottom end of the bottom pivot shaft 68 to thereby support the assembled lock plate and pivot shafts.

Referring to FIGS. 2 and 4, a U-shaped bracket 74 is fixed to a face of the lock plate 72 opposite the left side wall 18 with the open end of the bracket's U-shape facing upward. Between the vertical support plate 62*b* and the U-shaped bracket 74, the lock arm 58 deviates from its primary longitudinal axis defined by its linearly extending portion 58 concentric with the lock cylinder 56, first angling obliquely outward from the primary longitudinal axis and then bending again to form a second linear portion 58*b* passing through the U-shaped bracket 74 parallel to the first linear portion 58*a*, but radially outward therefrom. With reference to FIG. 2, the width of the opening in the U-shaped bracket 74 is only slightly larger than the diameter of the lock arm's circular cross-section. Accordingly, when the second linear portion 58*b* of the lock arm revolves eccentrically about the primary longitudinal axis of the lock arm 58, which is concentric with the key cylinder axis, the U-shaped bracket 74 is pushed or pulled by the movement of the lock arm, causing the attached lock plate 72 to pivot about the shared vertical axis of the pivot shafts 66, 68.

The figures show the lock plate 72 in its locking position, in which it projects inwardly away from the left side wall 18 at an oblique angle from its attachment to the pivot shafts 66 immediately adjacent the left side wall 18. The right side wall 36 of each drawer extends past the corner intersection of the drawer's two side walls. This projecting end portion 36*a* of the drawer's right side wall 36 thus juts out from the right side wall at the rear end of the drawer toward the left side wall 18 of the frame or housing of the chest proximate the rear corner edge 20 thereof. Under operation of the key cylinder 56 to rotate the lock arm 58 and displace the U-shaped bracket 74 fixed to the lock plate 72 at a distance radially outward from the pivot shafts 66, 68, the lock plate 72 is pivotal into the illustrated locking position in front of the projecting end 36*a* of the right side wall 36 of each drawer to block pivoting of the drawer out of its closed position about the pivotal connection of the drawer to the vertical shaft 46 adjacent the open front of the housing. Operating the key lock to move the U-shaped bracket in the other direction pivots the lock plate 72 back toward the left side wall 18 of the housing into an orientation more parallel thereto, thereby withdrawing the rear edge of the lock plate 72 opposite the pivot shafts 66, 68 from in front of the jutting end portion 36*a* of the drawer's side wall 36, thereby effectively unlocking each drawer to allow opening thereof.

FIGS. 5 to 9 show a second embodiment tool chest 100 also featuring swiveling drawers, but featuring a housing having a shape reflecting half of an octagon when viewed in plan. The frame or housing thus features a planar vertical rear wall 102, two planar vertical rear side walls 104, 106 extendingly obliquely and symmetrically forward from the rear wall 102 in a diverging manner, and two planar vertical front side walls 108, 110 projecting forward from the rear side walls 104, 106. The forward ends of the front side walls 108, 110 inwardly directed flanges 112, 114 projecting perpendicularly inward from the front side walls 108, 110 have been formed by right angle bends in the sheet or plate material defining these walls, and these flanged front ends of the front side walls define the opposing sides of the rectangular open front face of this embodiment's housing. A cover 116 is similar to that of the first embodiment in that it is made up of a flat horizontal panel spanning between all the walls and the open front face and a series of downwardly directed vertical integral flanges depending downward over the top portion of each wall, but differs in that it further includes a downward flange 116*a* at the front of the cover to form the top boundary of the open front of the housing, instead of using a separate cross member to form this boundary.

Figure 6:
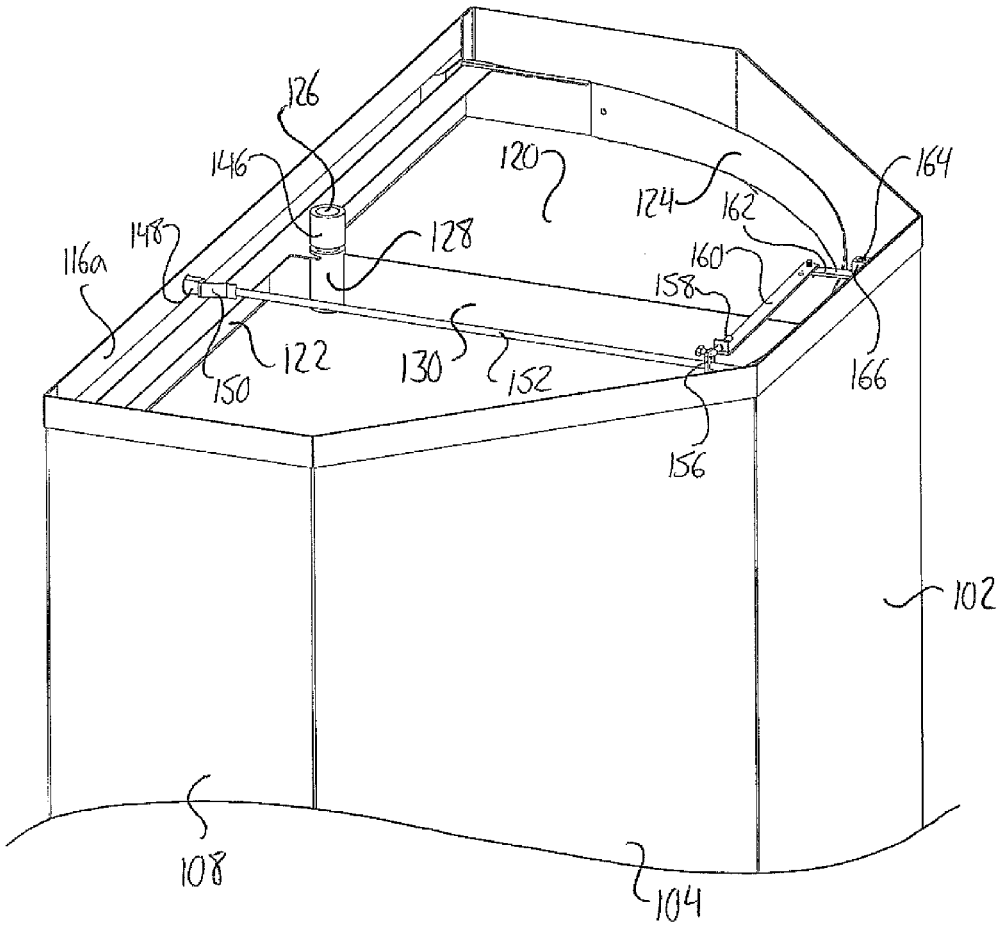
FIG. 6 is a partial top, rear, right side isometric view of the second embodiment tool chest with a top panel thereof cut away.
Figure 7:
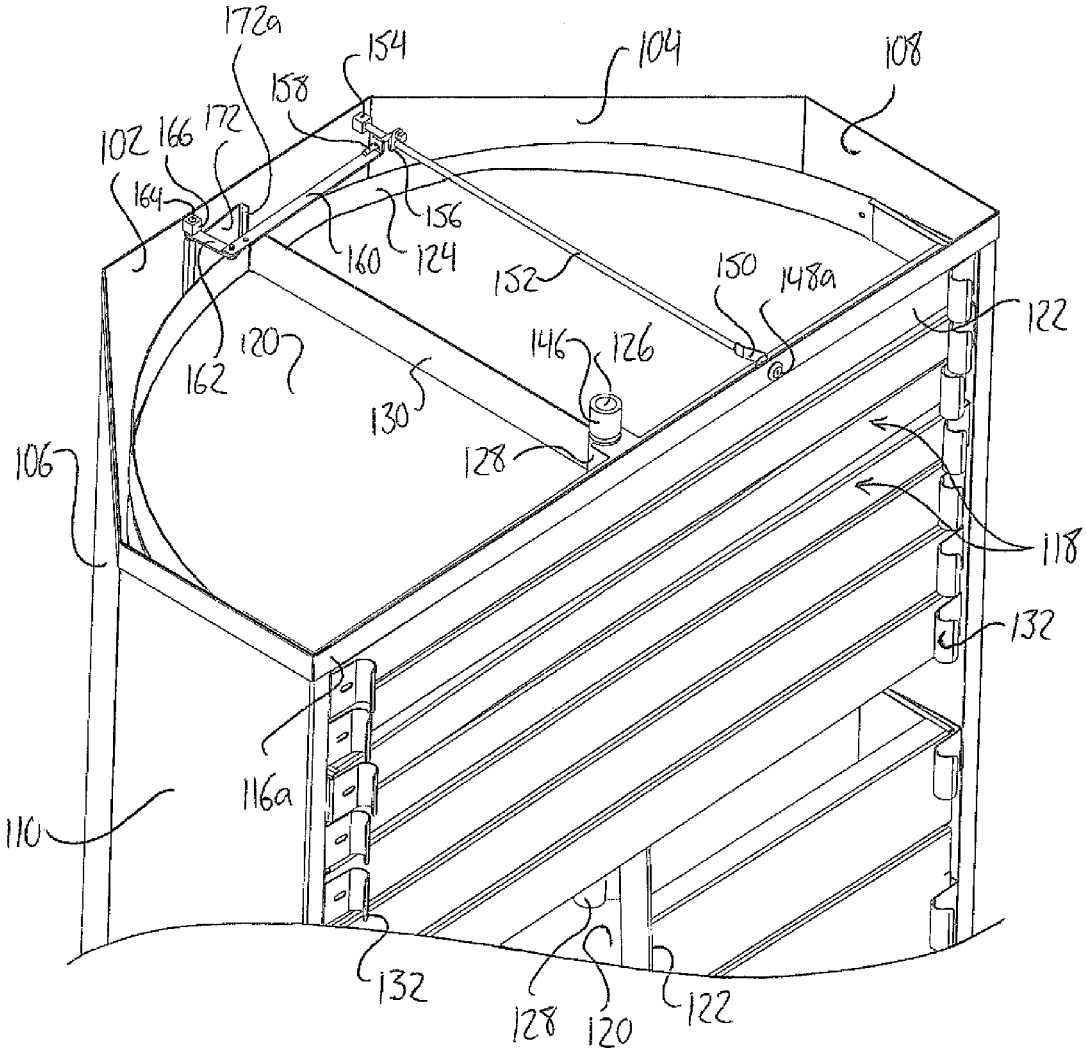
FIG. 7 is a partial top, front, left side isometric view of the second embodiment tool chest with the top panel thereof cut away.

The drawers 118 of the second embodiment feature a generally semicircular horizontal planar bottom 120, a vertical planar front wall 122 projecting upward from a linear front edge of the drawer bottom, and a generally arcuate wall section 124 following the generally arcuate edge of the drawer bottom 120 to interconnect the opposite ends of the front wall 122. The opposing ends of the front wall 122 are disposed adjacent the opposite sides of the open front of the housing when the drawer is closed so that each drawer substantially fills the width of the planar open front face of the housing. The drawers are once again pivotal about a vertical shaft 126 disposed inwardly adjacent the open front face of the housing, but in this embodiment the shaft 126 is disposed at a midway point between the front side walls 108, 110, not adjacent one of the open face sides. As shown in FIGS. 6 and 7, each drawer thus accommodates a hollow cylindrical sleeve 128 in its construction at a point just rearward of the front face 122 of the drawer in line with the midpoint of the front face's length to rotatably carry the drawer on the shaft 126. The curved wall section 124 follows an arcuate path about the axis of the sleeve 128 for most of its length, but then at each end extends linearly where it passes the sleeve 128 to connect to the front wall of the drawer, the overall drawer and bottom wall thereof accordingly having a nearly, but not perfectly, semicircular shape in plan. As shown, a central divider wall 130 of the drawer may be included to connect the cylindrical sleeve 128 to the front wall 122 and the arcuate wall 124 along a radial plane of the shaft in line with the midpoint of the front wall 122. The walls of the half octogonal shape of the housing in plan follow similarly along an arcuate path about the shaft on which the drawers are pivoted, the corners between the front side and rear side panels and the corners between the rear and rear side panels lying on a horizontal circle about the pivot shaft's axis, this circle being of larger radius than the arcuate drawer wall in order to accommodate the drawer inside the housing. It will be appreciated that other housing shapes could similarly accommodate pivoting of the drawers, for example a rectangular housing spanning the same overall width of the half-octogonal housing or a housing with an arcuate rear wall section spanning most of the distance behind the opposite sides of the open front.

Each drawer can be pivoted about the shaft in either direction out of the closed position, in which the front wall of the drawer is disposed in the plane of the housing's open front and the storage area of the drawer bound between the front and arcuate walls thereof is situated entirely within the housing. Pivoting the drawer in either direction out of the closed position by ninety degrees will place nearly a full half of the drawer outside the housing in front of the open face thereof. Alternatively, the drawer can be pivoted through one hundred and eighty degrees to situated nearly the entire storage space of the drawer outside the housing for complete access. This embodiment again employs close spacing of the drawers within a single column or vertical row using thin lubricated washer-like spacers to substantially fully close the open front face of the housing when all the drawers are closed. As the drawers can be pivoted in either direction, each drawer features two pull handles 132, one adjacent each end of the drawer's front face for gripping from outside the housing when the drawer is closed.

Figure 9:
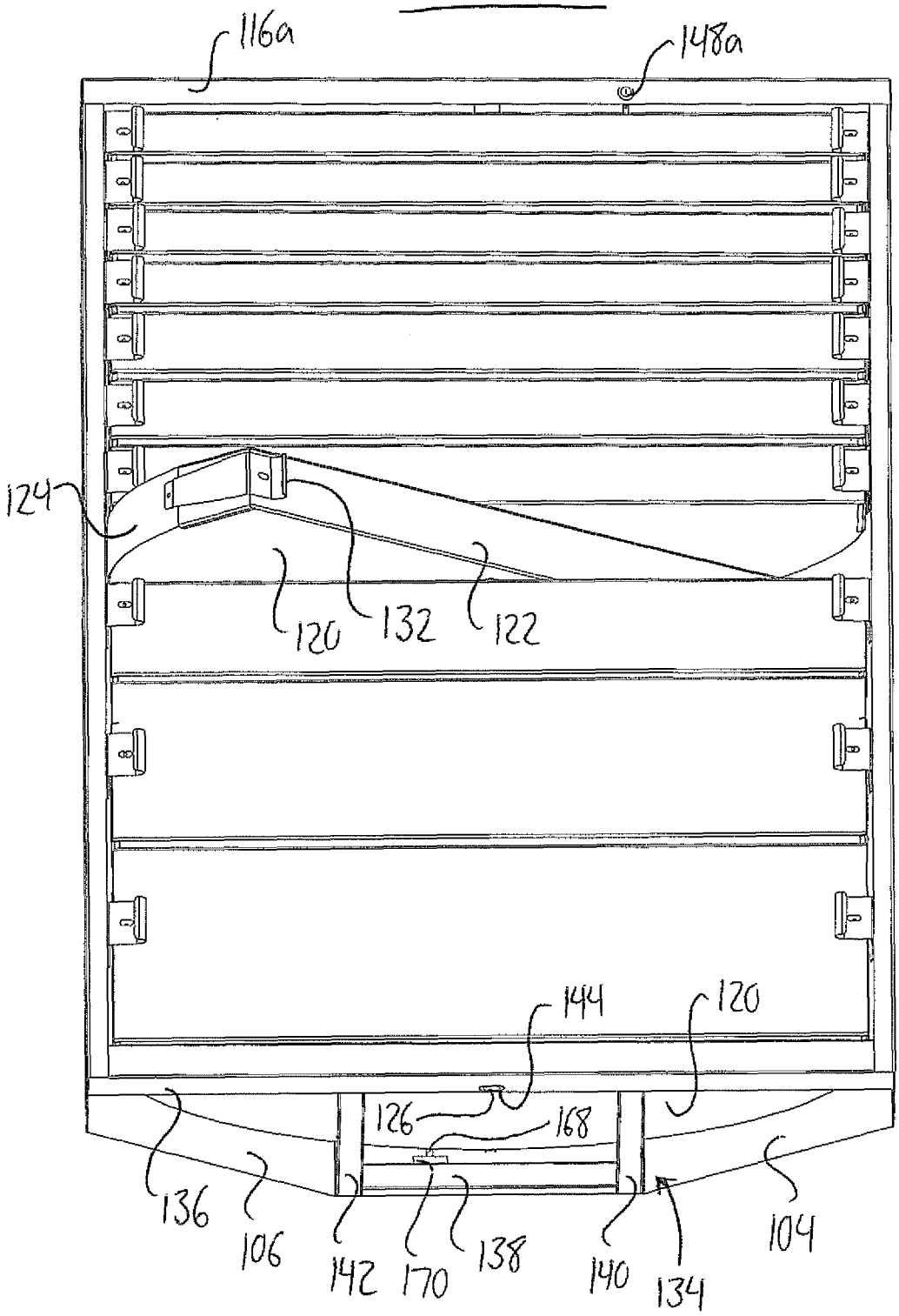
FIG. 9 is a bottom, front isometric view of the second embodiment tool chest.

FIG. 9 shows a bottom of the second embodiment chest 100, in which the base 134 features a bottom cross member 136 in the form of a length of rectangular tubing spanning between the front side walls 108, 110 immediately behind the front end flanges 112, 114 thereof at the bottom of these walls. A rear cross member 138 is provided by a shorter length of rectangular tubing fixed to the rear wall 102 of the housing to extend horizontally along the width of the rear wall at the bottom end thereof. Two additional base members 140, 142 perpendicularly interconnect the parallel front and rear cross members 136, 138 just inside the corners between the rear wall 102 and the rear side walls 104, 106. The horizontal bottom faces of the tubular base members are coplanar with the bottom edges of the walls to support the chest atop a suitable horizontal support surface. A bottom hollow cylindrical collar 144 is fixed within a vertical through hole in the front cross member 136 to rigidly receive the bottom end of the vertical shaft 126 on which the drawers pivot. Referring to FIGS. 6 and 7, a top hollow cylindrical collar 146 is fixed to the bottom face of the central horizontal panel of the cover 116 to likewise rigidly receive the top end of the stationary vertical shaft 126.

The locking mechanism of the second embodiment again uses a key cylinder 148, this time mounted to the front vertical flange 116*a* of the cover 116 with its key slot 148*a* at the outer face of the cover's front flange 116*a*. A coupler 150 again fixes a locking arm 152 concentrically to the key cylinder for rotation therewith, but the locking arm in this embodiment being entirely linear from end to end. The end of the locking arm 152 opposite the key cylinder 148 is rotatably received in a horizontal bore in a pivotal support block 154 fixed to the inner face of the rear wall 102. A connection bracket 156 fixed on the lock arm 152 near the rear wall 102 rotates therewith and pivotally supports a first link 158 over the lock arm 152 when in an unlocked position. The first link 158 extends toward the left side of the housing laterally away from the lock arm 152, which projects perpendicularly between the parallel rear wall and open front face of the housing adjacent the connection of the rear wall and rear right side wall 104. The connection bracket allows pivoting of the first link about an axis parallel to that of the lock arm 152. A linearly extending second link 160 fixed at one end to the first link 158 continues laterally away from the lock arm toward the left side of the housing and, just past the mid vertical plane of the chest in which the divider wall of each drawer lies when closed, has its other end pivotally connected to a linear third link 162 for relative pivoting between the second and third links about a generally vertical axis. The third link 162 extends rearward toward the rear wall 102 where it is pivotally coupled with a top pivot shaft 164, which like that of the first embodiment has its upper end rotatably received in a support block 166 fixed to the underside of the horizontal cover panel.

Figure 8:
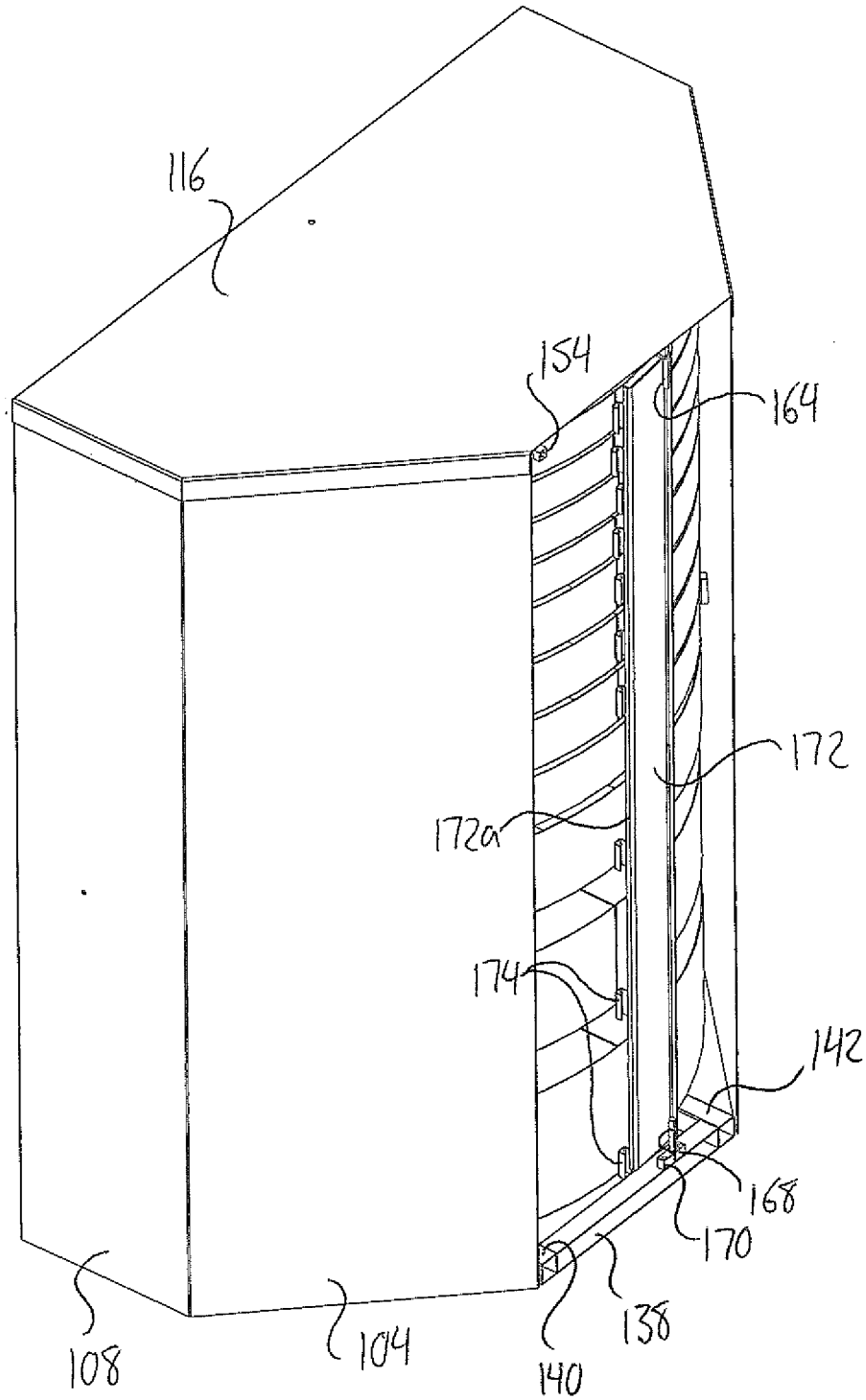
FIG. 8 is a top, rear, right side isometric view of the second embodiment tool chest with a rear panel thereof cut away.

As shown in FIGS. 8 and 9, a bottom pivot shaft 168 likewise has its bottom end rotatably received in a bottom support block 170 mounted atop the rear cross member 138 of the base 134. A substantially plate-like blocking member 172 is rigidly coupled with the pivot shafts 164, 168 to project outward therefrom, but differs from the lock plate of the first embodiment in that it is bent through ninety degrees in opposite directions near its opposite edges, as shown in FIGS. 7 and 8, to give the blocking member 172 a squared-off S-shaped horizontal cross section. One of the bent ends curves about the pivot shafts at the coupling of the blocking member 172 thereto. As also shown in FIG. 8, each drawer has a U-shaped channel piece 174 fixed to the outside face of the arcuate wall 124 at the point therealong where it meets the center divider wall 130. The longitudinal axis of the channel piece is oriented vertically, so that its squared-off U-shaped cross section is in a horizontal plane. The channel piece thus present a pair of vertical walls projecting a short distance outward from the rear face of the drawer's arcuate wall.

In the figures, the blocking member 172 is shown in the unlocked position, where its central plate portion between its bent ends lies nearly parallel to the rear wall 102 of the housing between the arcuate walls of the closed drawers and the rear wall 102. Under rotation of the key cylinder 148 in a locking operation, the linkage joining the rotating lock arm 152 pivots the pivot shafts rigidly linked by the vertical blocking member 172 in a direction moving the free bent end of the blocking member opposite the pivot shafts further inward away from the rear wall 102 to position this bent end 172*a* between the vertical walls presented behind each drawer by the U-shaped channel piece 174. With the bent end 172*a* of the blocking member positioned between the walls of the channel piece 174, pivoting of the drawer in either direction is blocked, thereby effectively locking the drawer closed.

Figure 10:
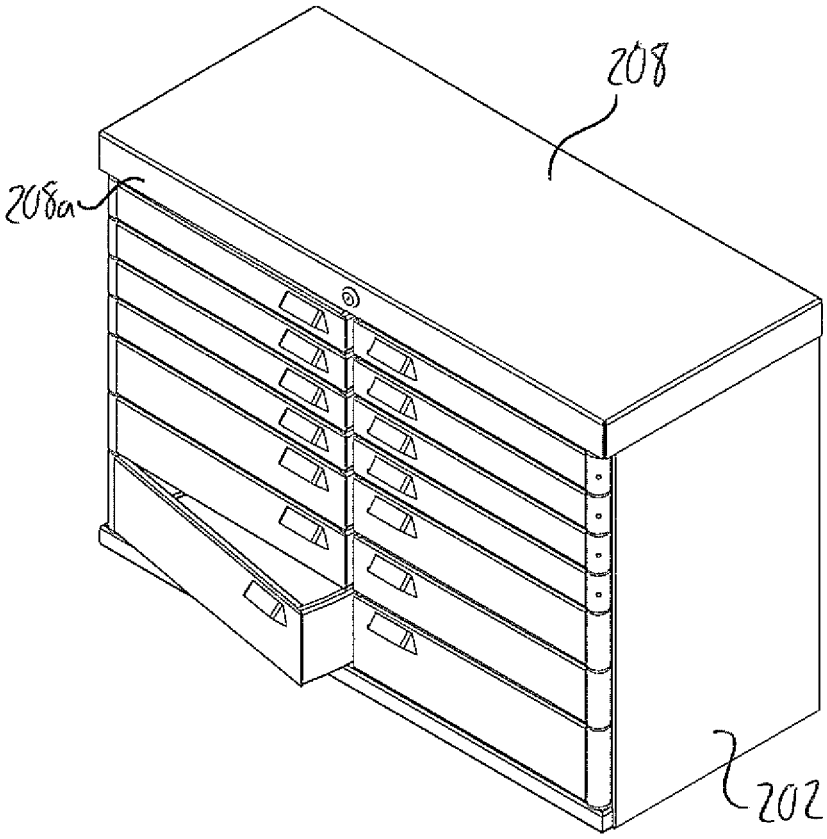
FIG. 10 is a top, front, right side isometric view of a tool chest according to a third embodiment of the present invention.
Figure 13:
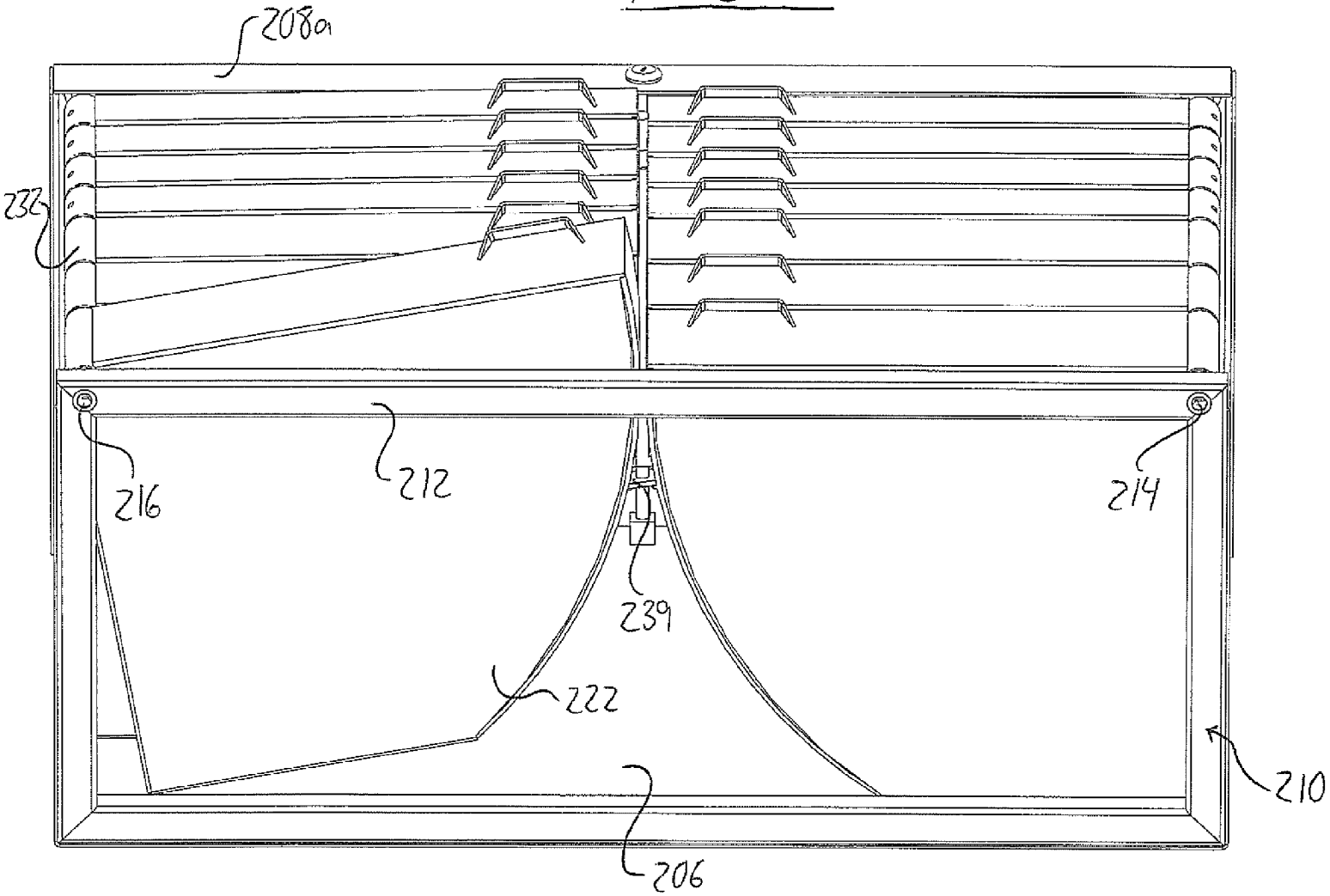
FIG. 13 is a bottom, front isometric view of the third embodiment tool chest.
Figure 14:
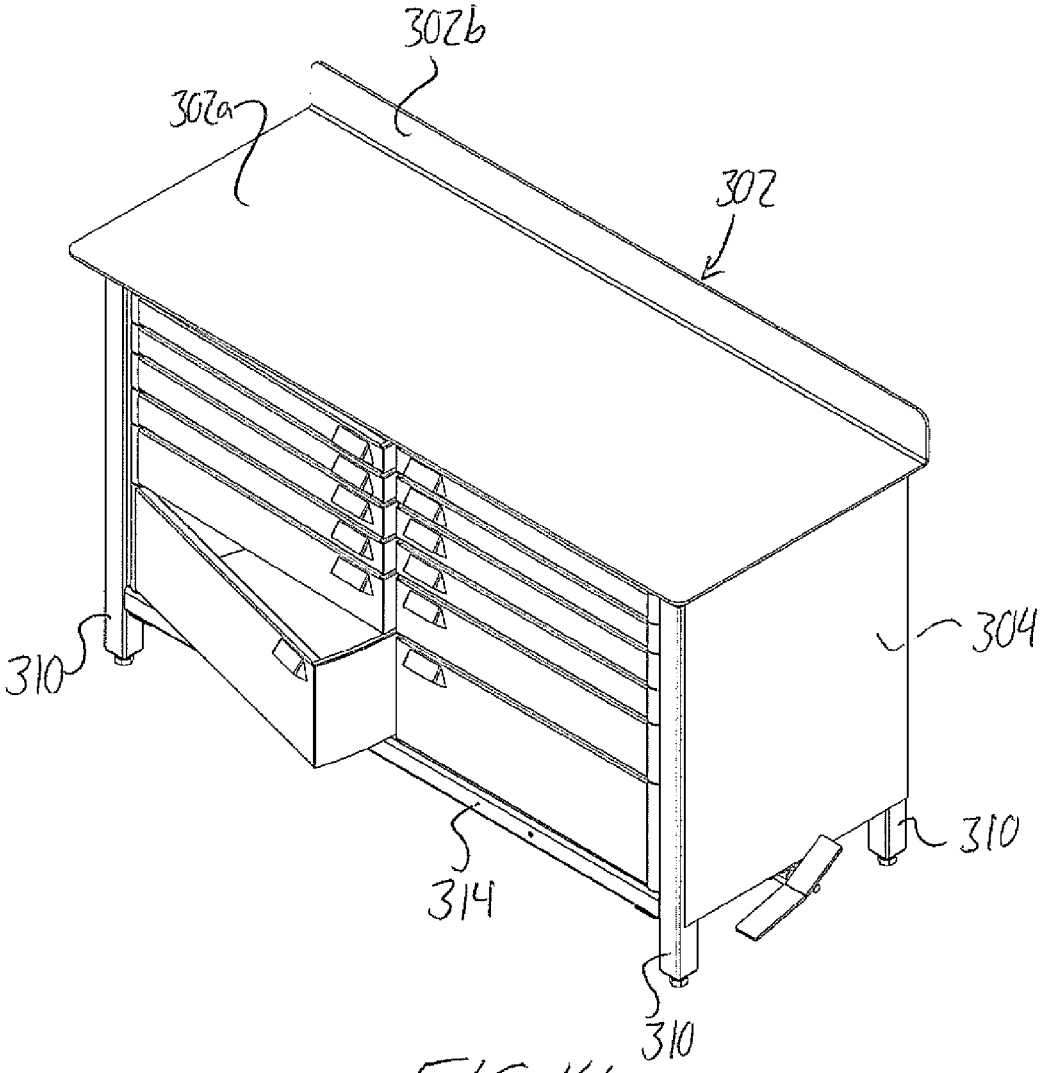
FIG. 14 is a top, front, right side isometric view of a tool chest work bench according to a fourth embodiment of the present invention.

FIG. 10 shows a third embodiment tool chest 200 that is rectangular in plan, feature two parallel planar vertical side walls 202, 204 and a longer planar vertical rear wall 206 perpendicularly connecting the side walls. A cover 208 has a planar horizontal portion 208*a* and four downward depending vertical flanges, three of which project downward over the top portions of the outer surfaces of the housing walls, and the other flange 208*a* project downward in front of the side walls 202, 204 to define the top boundary or cross member of the rectangular open face of the housing, like in the second embodiment. With reference to FIG. 13, the base 210 is made up of four lengths of rectangular tubing fixed together at their ends to form a rectangle to seat bottom faces of the tubing on horizontal ground to support the chest 200. The one of the two longer pieces of tubing opposite the rear wall 206 forms the bottom cross-member 212 defining the lower boundary of the housing's open front face. The bottom cross member 212 is positioned such that part of its vertical cross-section projects forward from the front edges of the two side walls 202, 204. The rest of the rectangular assembly of tubular base members is disposed within the area between the housing walls, which are fixed to the outer faces of the other three base members.

Figure 12:
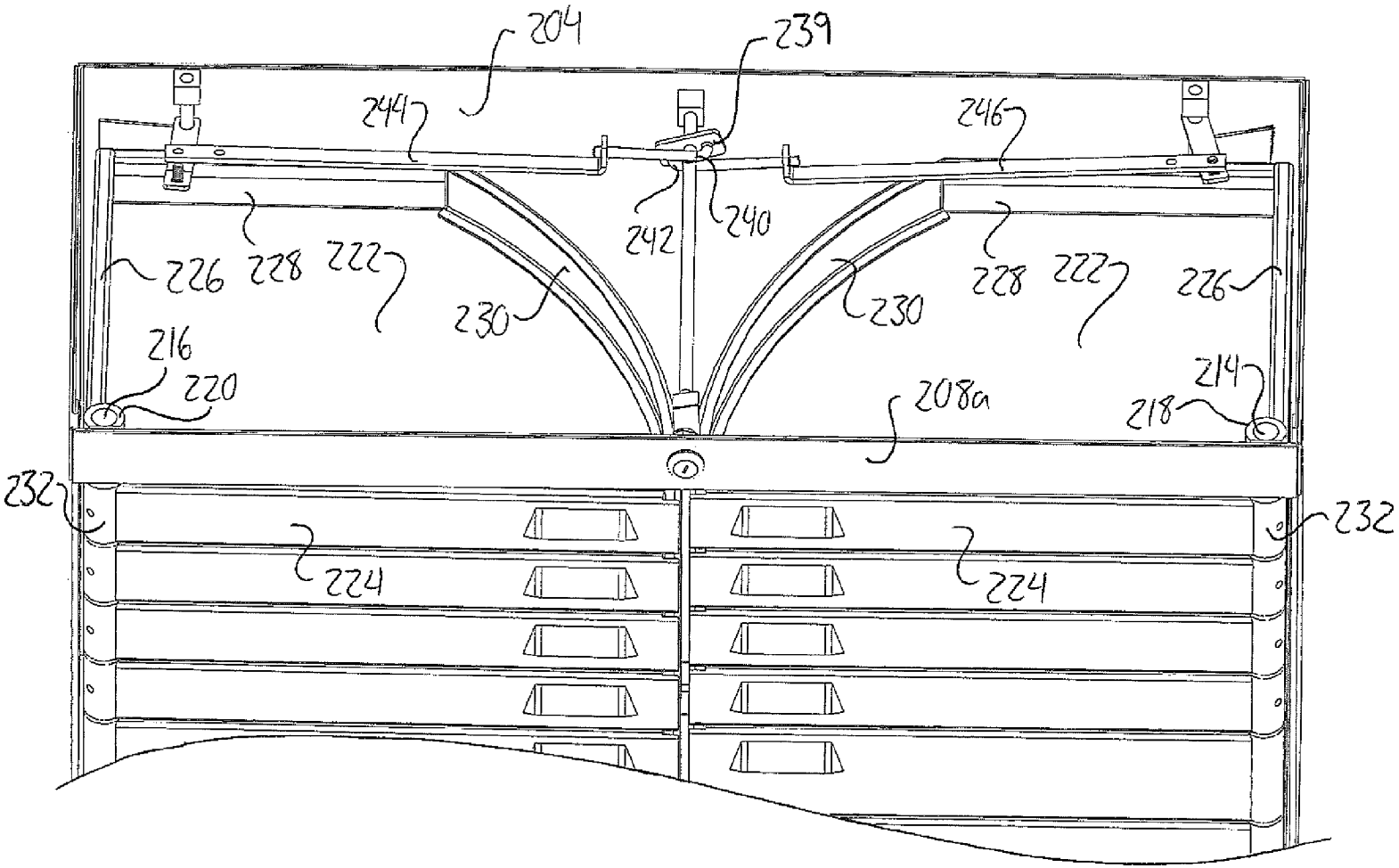
FIG. 12 is a partial top, front isometric view of the third embodiment tool chest with a top panel thereof cut away.

Adjacent the opposite ends of the bottom cross member 212, two vertical shafts 214, 216 are rigidly received within vertical through bores in the assembled tubing sections of the base 210. Top ends of the vertical shafts 214, 216 are rigidly received in vertical through bores of generally cylindrical hollow support collars 218, 220 (FIG. 12) fixed to the inside of the cover 208. Each of the two shafts 214, 216 forms the pivotal support point for a respective column or vertical row of drawers. In the illustrated embodiment, the number of vertically spaced drawers in each of the two columns is equal, and each drawer in one column is equal in height and position to a corresponding drawer in the other column.

Each drawer features a planar bottom 222, a planar vertical front wall 224, a planar vertical side wall 226 disposed perpendicular to the front wall on one side thereof, a rear wall 228 projecting from an end of the drawer's side wall 226 opposite the drawer's front wall in a direction parallel thereto, and a curved vertical wall section 230 connecting the end of the drawer's rear wall opposite the drawer's side wall with the end of the drawer's front wall opposite the drawer's side wall. The curved wall section 230 curves about the vertical axis of the respective shaft 214, 216 so that the curved wall surface facing into the drawer's storage space is concave and the wall surface facing out of the drawer is convex. The hollow cylindrical sleeve 232 of each drawer fitted about the respective shaft to provide the pivotal action of the drawer forms the connection between the perpendicular front and side walls of the drawer.

The drawer's rear wall is shorter in length than the front wall of the drawer, and the connection provided by the rear wall and curved wall between the front and side walls is configured with a rear wall length and curved wall curvature such that in each pair of corresponding drawers from the two columns, the two side-by-side drawers having their curved walls facing together toward the center of the chest are each pivotal about the respective vertical shaft without contacting or interfering with the operation of the other drawer. It will be appreciated that if the drawers were rectangular in plan with the ends of their front faces situated side-by-side in the close proximity illustrated, the drawers would not be pivotal, as the radial arm from the pivot axis to the diagonally opposite corner of the drawer would exceed the space between the drawer's shaft and the front wall of the corresponding drawer in the other column. Rectangular drawers would thus require either widening of the chest or narrowing of the drawers to provide empty space between the corresponding drawers of the adjacent columns to accommodate the overlapping paths of the movement of the two drawers.

Figure 11:
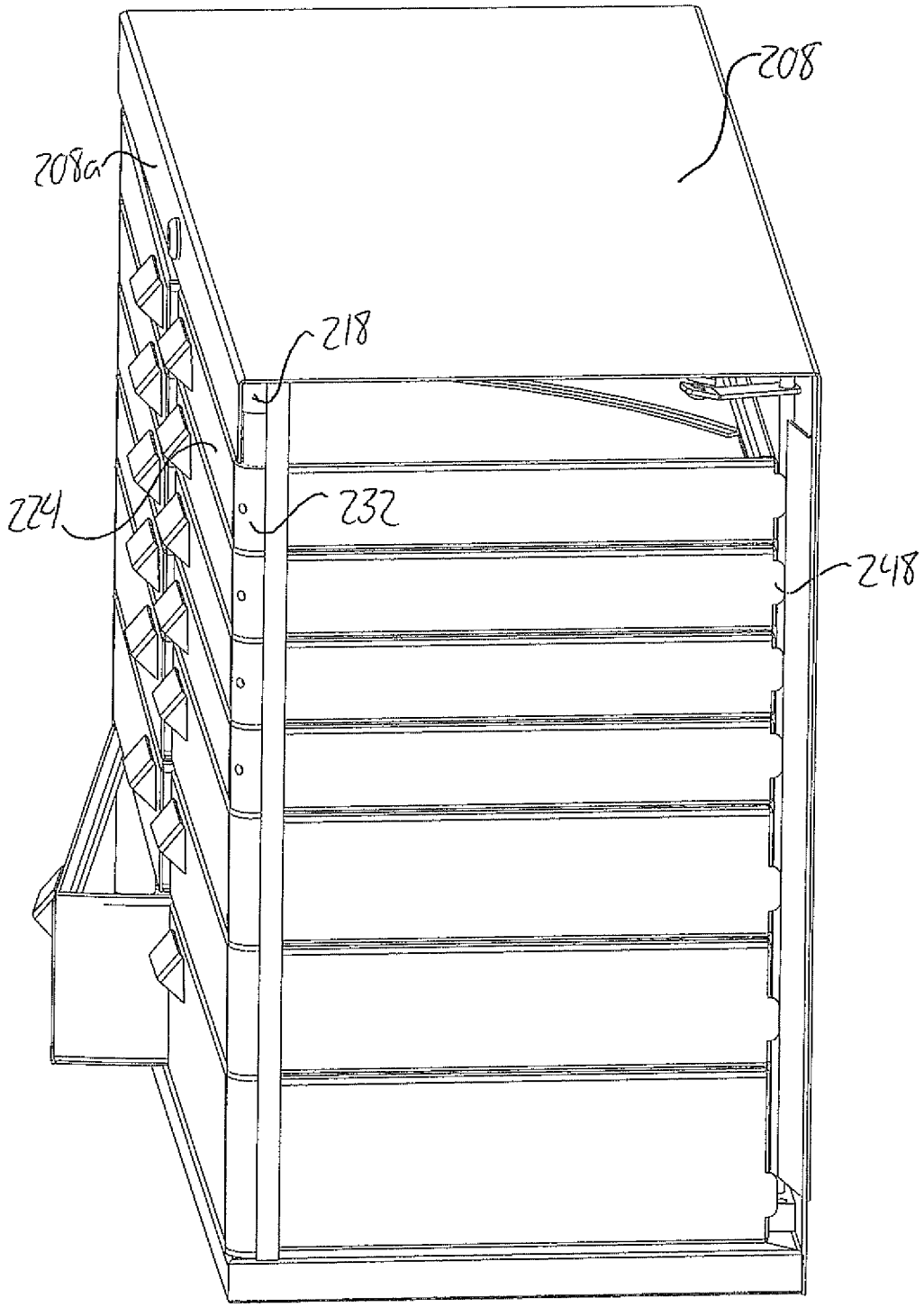
FIG. 11 is a top, right side isometric view of the third embodiment tool chest with a right side panel thereof cut away.

The locking mechanism of the third embodiment again uses a key cylinder mounted to the front vertical flange 208*a* of the cover 208 with its key slot at the outer face of the cover's front flange 116*a*. A coupler again fixes a linear locking arm concentrically to the key cylinder for rotation therewith. In this embodiment, the connection bracket 239 fixed on the lock arm near the rear wall 102 pivotally supports projects to diametrically opposed sides of the lock arm 240, to pivotally support a first link 240, 242 on each side. The locking arm is centrally positioned along the vertical front flange 208*a* of the cover 208, and the first link 240, 242 connected on each side of the locking arm crosses the locking arm toward the opposite side thereof, where it is fixed to a respective second link 244, 246 continuing onward toward the side of the housing opposite the side of the locking arm at which the first link is coupled thereto. At an end of each second link nearest the side wall toward which it extends, a third link pivoted on the second link connects to a respective top pivot shaft in the same manner as the second embodiment, each top pivot shaft having a corresponding bottom pivot shaft rotatably mounted on the rear cross member of the base in the same manner as the second embodiment. Each pairing of top and bottom pivot shafts is interconnected by a plate member like in the first embodiment so that pivoting of the top shaft will pivot the plate toward and away from the rear wall into the unlocking and locking positions respectively. With respect to FIG. 11, a tab 248 formed at the end of each drawer's side wall opposite the front wall projects past the drawer's rear wall, toward but not reaching the housing's rear wall when the drawer is closed. The plate is pivotal into and out of a position projecting inwardly away from the rear wall by an amount sufficient to place its distal edge opposite the pivot shafts on the interior side of the tab to block the tab from moving under attempts to open the drawer by pivoting the drawer side wall away from the housing side wall.

The angular position of the connection bracket 239 with the locking arm in the unlocked position is preset so that rotating the locking arm in the locking direction under key operation of the key cylinder will pull the second link on each side of the locking arm toward the locking arm at the center of the chest, thereby pivoting both the locking plates away from the rear wall toward the rear wall of the drawer into the blocking positions obstructing movement of the projecting tabs of the drawers under attempts to open the same, thereby effectively locking all of drawers in each of the two columns.

The handles of the drawers of the third embodiment are different than the preceding embodiments, but are of a known type, and therefore not described herein in detail.

FIGS. 14 to 17 show a fourth embodiment tool chest 300 that also doubles as a work bench. The cover 302 in this embodiment differs due to this intended work bench application, accordingly being provided in the form of a bent plate or sheet having a rectangular horizontal portion 302*a* overhanging the chest frame below at the front and sides thereof and a rectangular vertical portion 302*b* projecting upward along the rear of the horizontal portion to prevent items from sliding, rolling or otherwise falling off the rear of work surface provided by the horizontal portion. As shown, the counter-like cover or top may be rounded off at its corners for safety reasons. Although not shown in the Figures, the cover is mounted on a top frame portion of the chest provided in the same structure as the bottom base of the third embodiment, with four length of rectangular tubing interconnected at their ends in a rectangular configuration. The parallel vertically planar side walls 304, 306 and the vertical planar rear wail 308 perpendicularly interconnecting the side walls are secured to the outer faces of the corresponding side and rear members of the top frame portion of the housing immediately beneath the top cover.

Figure 15:
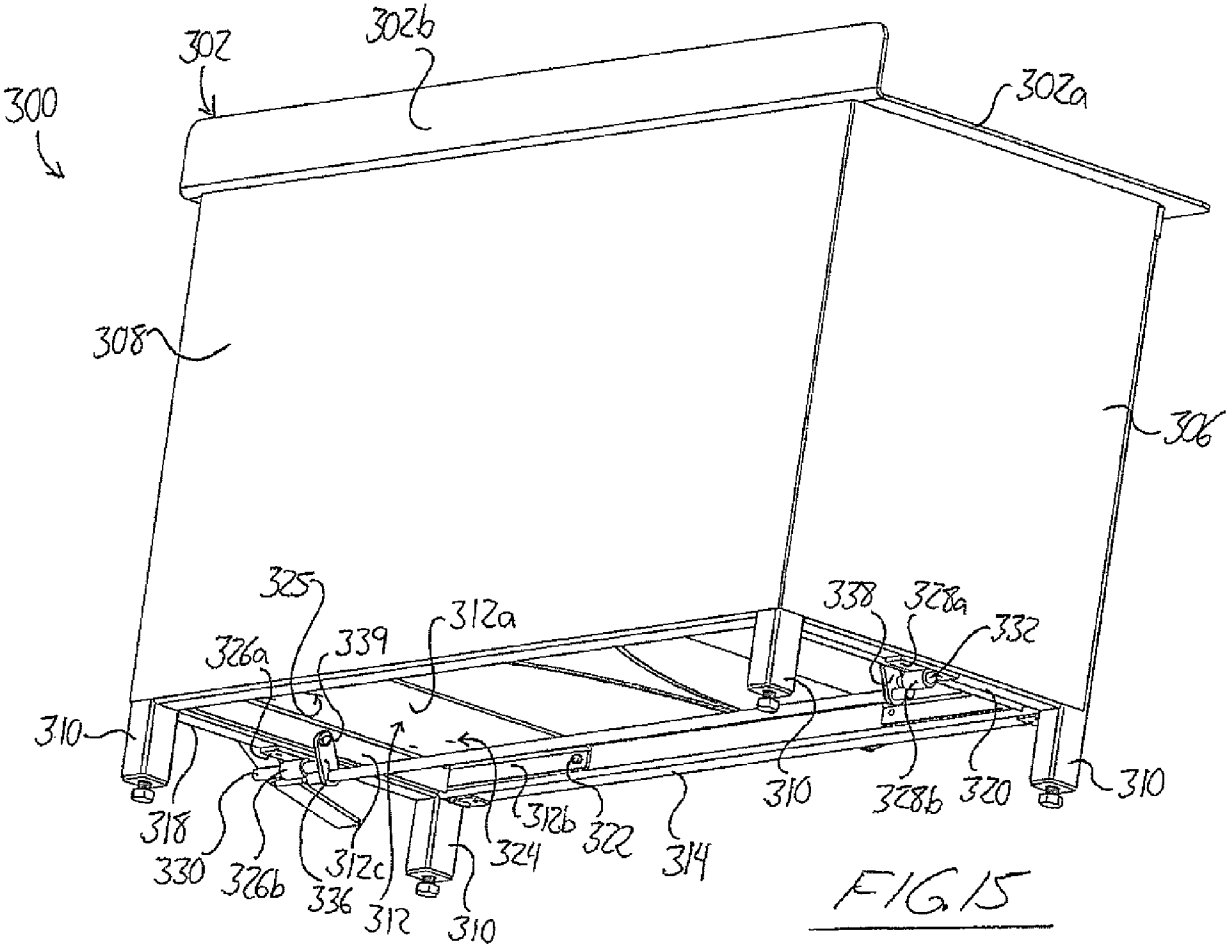
FIG. 15 is a bottom, rear, left side isometric view of the fourth embodiment tool chest work bench, with wheels thereof omitted.

The frame also differs from that of third embodiment in that it features four vertical legs 310 projecting downward past the base of the frame from where they attach to the bottom of the top frame portion at the corners thereof. With reference to FIG. 15, the base of the frame is similar to that of the third embodiment, except that the four tubular members are connected to one another at their ends by the legs 310 instead of being directly fixed together. The vertical shafts on which the drawers pivot are fixed in vertical bores extending upwardly into the front cross member of the top frame portion defining the upper boundary of the frame's open front face at positions just inward from the front legs of the chest, with the drawer structure otherwise being the same as in the third embodiment and employing a similar locking mechanism having the key cylinder pass through the member of the top frame portion defining the top cross member boundary of the frame's open front face and having linkages extending toward opposite ends of the chest interior to pivot locking plates into and out of positions blocking features projecting from the rear walls of the drawers. Although not shown, in this embodiment, these projecting features are provided in the form of a short vertically-extending tubular member fixed to the rear wall of each drawer proximate the connection thereof to the drawer's side wall, each upright drawer wall being provided by a section of vertically oriented C-shaped channel.

As the fourth embodiment may be used as both a tool chest and a workbench, it is equipped with a system for selectively deploying a set of wheels into positions where the wheels depend further downward than the legs 310 on which the unit is to be supported when being used as a stationary workbench, or anytime that mobility of the unit is not required. For ease of illustration, a set of four caster wheels 311, two of which of visible, are present and deployed on the unit in the front elevational view of FIG. 17, but omitted from the other views.

With reference to FIGS. 15, a pair of wheel support members 312 are carried on the frame adjacent opposite ends thereof, that is, each closer to a respective one of the two opposing side walls 304, 306. The structure of each wheel support member has the form of a rectangular top plate 312*a*, having smaller rectangular plate sections forming flanges depending perpendicularly downward from the top plate at three of its four edges. A front one of these flanges 312*b* is situated adjacent the inner face of the front cross member 314 of the frame's base defining the bottom boundary of the open front face of the frame where the drawers are installed. A rear one of the wheel support member flanges (not shown) is disposed opposite and parallel to the front flange 312*b* at a position adjacent the inner face of the rear cross member 316 of the frame's base. The final side flange 312*c* of the wheel support member spans perpendicularly between the front and rear flanges at a short distance inward from the inner face of the side member 318, 320 of the frame's base adjacent the respective side wall 304, 306 of the chest.

The front and rear flanges of each wheel support member are pivotally secured to the front and rear cross members 314, 316 of the frame's base respectively by pivot pins 322, for example as provided by bolts, concentric with one another on an axis perpendicular to the front and rear base members 314, 316. This pivot axis is provided at a distance from the side flange 312*c* of wheel support member, nearer an opposite end thereof closer to the central vertical plane of the chest cutting perpendicularly through the front and rear base member's thereof. The end of the wheel support member nearest the respective side wall is free to pivot upward and downward about the pivot axis, and accordingly the side flange 312*c* is not directly fastened to any part of the frame. Near this free end of each wheel support member, a short distance away from the side flange 312*c* at this end, two sets 324, 325 of four fastener holes are provided in the top plate 312*a* of the wheel support member at spaced positions along the respective side member of the frame base adjacent the front and rear of the chest respectively, each set arranged for fastening of a mounting plate of caster having the same bolt fastening hole pattern (two holes of each set in one of the wheel support members is visible in FIG. 15).

A pair of brackets 326, 328 are mounted to the underside of the side members 318, 320 of the frame's base, each featuring a mounting plate 326*a*, 328*a* mounted flush thereagainst and a bushing or bearing 326*b*, 328*b* carried on the mounting plate therebeneath. A short respective shaft 330, 332 is rotatably carried in each bushing and projects a short distance inwardly therefrom toward the opposite side of the chest. These short shafts 330, 332 and their bushings 326*b*, 328*b* are coaxial so as to lie on a common longitudinal axis parallel to the front and rear members 314, 316 of the frame's base at a position half way therebetween. A much longer shaft 334 is rigidly fixed eccentrically to each of the two short shafts 330, 332 to extend along an axis parallel to the longitudinal axis on which the short shafts lie so that one short shaft will rotate with the other, and such rotation will cause the longer shaft to revolve about the longitudinal axis.

Figure 16:
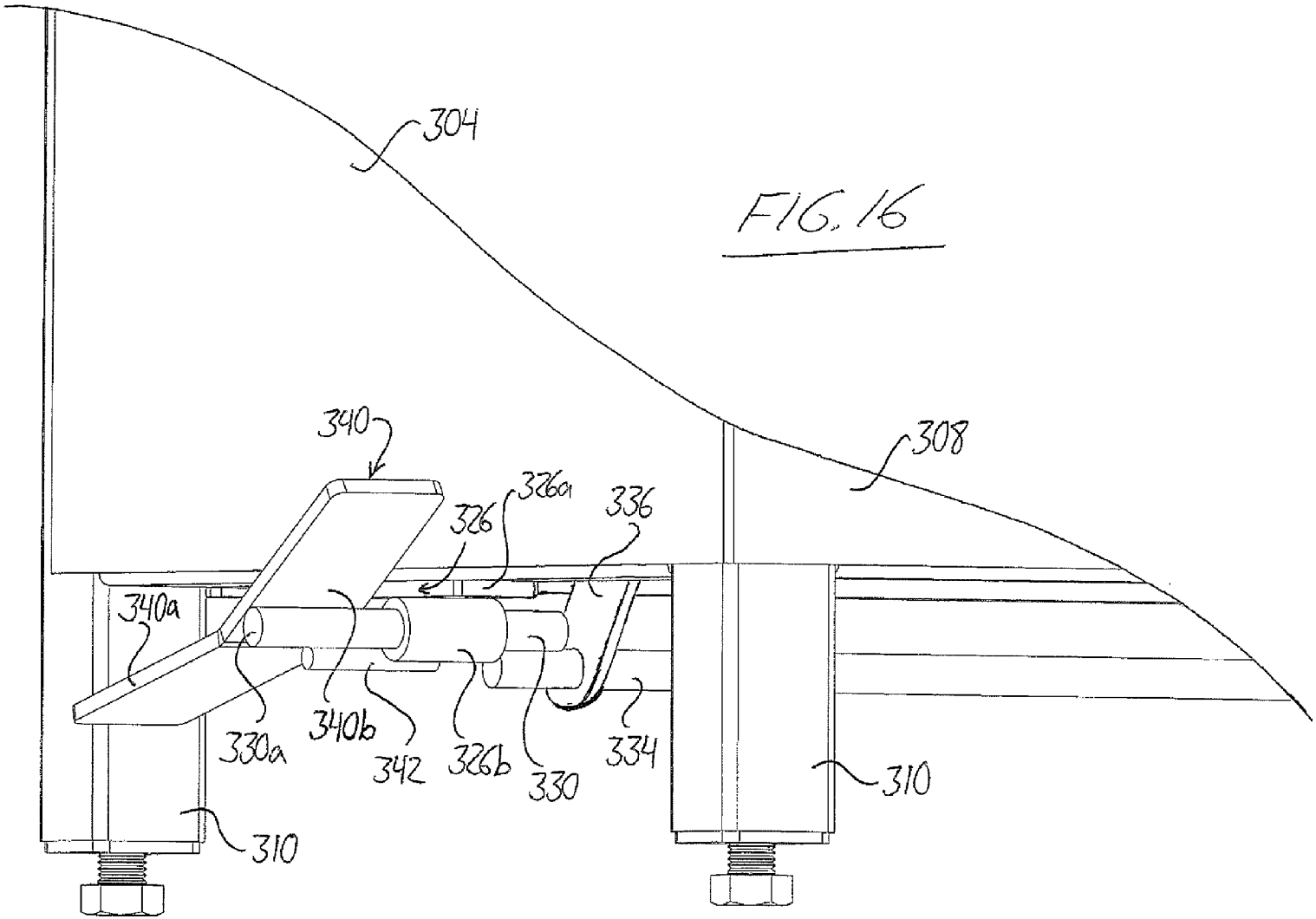
FIG. 16 is a partial rear, right side isometric view of the fourth embodiment tool chest work bench, with the wheels thereof omitted.
Figure 17:
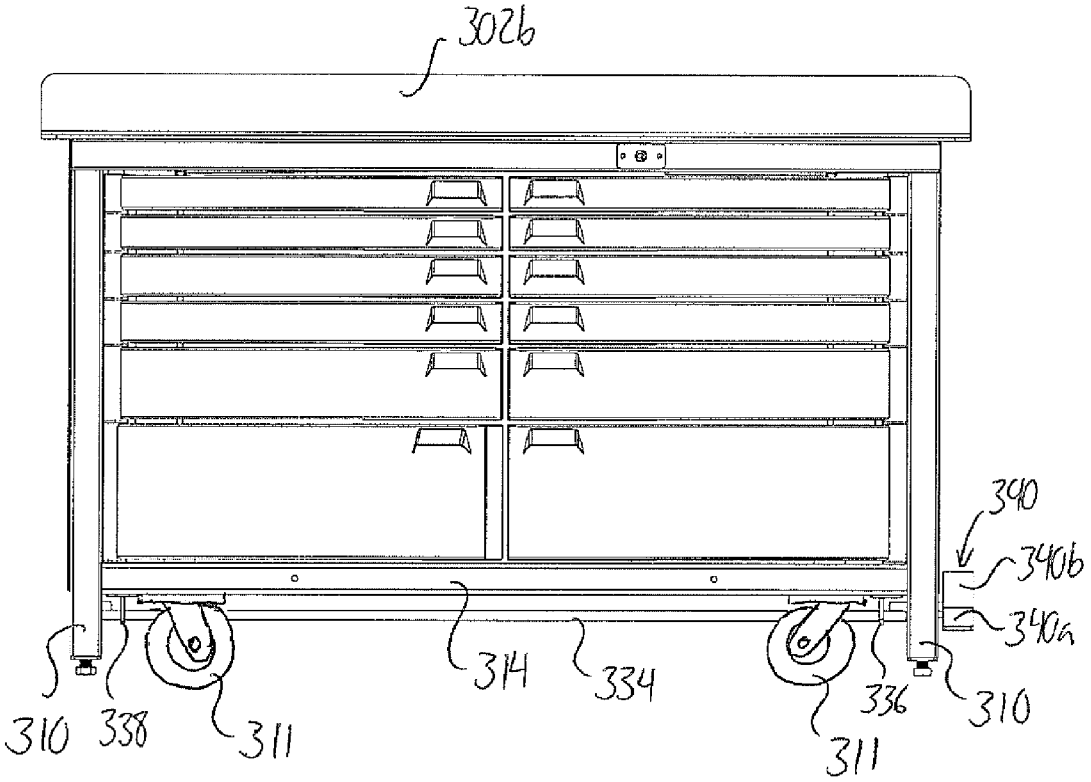
FIG. 17 is a front elevational view of the fourth embodiment tool chest work bench, including the wheels thereof.

At positions along the longer shaft 334 near the opposing side members 318, 320 of the frame's base, but each between the side flanges of the two wheel support members, the shaft 334 passes through holes in linking brackets 336, 338 such that these brackets are rotatable about the shaft. At a hole in each linking bracket near the end thereof opposite its pivotal connection to the shaft, a pivot pin 339, for example as provided by a bolt, passes through the bracket and pivotally connects it to the side flange 312*c* of the respective wheel support member at a at a mid-point along this side flange at the vertical plane in which the longitudinal pivot axis of the short shafts lies. With reference to FIGS. 15 and 16, the short shaft 330 adjacent the right side wall 304 of the chest also projects outwardly from its bushing 326*b* to situate one end 330*a* of the shaft outward from beneath the frame of the chest to a position laterally outward from the right side wall 304. At this projecting portion of the shaft 330, a pedal 340 is rigidly fixed to the shaft 330 near a middle portion of the shaft so as to pass over the shaft and project in two directions therefrom, thereby forming a front pedal portion 340*a* extending toward the front of the chest and a rear pedal portion 340*b* extending toward the rear of the chest. The pedal acts as a foot-operable lever for a user to control pivoting of the short shafts about their common axis.

The figures show the foot pedal 340 having been put into a wheel deploying position by depression of the front pedal portion 340*a* to move downward on the front side of the shaft 330. With reference to FIGS. 15 and 16, having the pedal in this position situates the long shaft 334 relatively low on its eccentric path about the short shafts, placing it below a horizontal radius diameter of the short shafts on the forward side of a vertical diameter of the short shafts. Movement of the long shaft 334 further downward past this point to the bottom-most point of the revolving path about the shorter shafts is prevented by engagement of the front portion 340*a* of the pedal 340 with a stop peg 342 rigidly fixed to the outside of the bushing 326*b* to project therefrom parallel to the short shaft 330 outward past the right side wall 304 of the housing. With the long shaft 334 positioned so low relative to the short shaft with the user's application of pressure on the pedal to bring the wheel deployment system to this point, the free ends of the movable wheel supports 312 are pulled down with the long shaft 334 by the linking brackets 336, 338 by a distance sufficient to pull the wheels mounted adjacent these free ends of the pivoting wheel supports far enough so as to extend past the bottom of the legs 310, and in doing so, lift the legs up off the ground for carrying of the chest on the wheels. In having brought the long shaft 334 over center on the short shafts in bringing the system to this point by use of the pedal, the weight of the chest being carried on the wheels through the wheel supports and the linking brackets only acts to force continued motion of the shafts in the same direction, but this is blocked by the stop peg 342 so that the long shaft 334 cannot reach an under center position around the short shafts and move back upward toward the base of the frame, which would cause the linking brackets to lift the wheels back up with the free ends of the movable wheel supports relative to the base of the frame and thereby drop the table back down onto its legs. Accordingly, the system automatically locks itself into the deployed wheel position when the front pedal portion is depressed sufficiently by a user to lift the legs off the ground a move the linking brackets over center on the short shafts.

To retract the wheels from the deployed position to rest the chest back on the legs depending downward from the base, the user depresses the rear portion of the pedal downward, which lifts the front portion of the pedal upward off the stop peg and moves the long shaft upwardly in the opposite direction about the short shafts, which lifts the wheel-carrying free ends of the movable wheel supports with it under the action of the linking brackets, thereby lifting the wheels relative to the base of the frame in order to lower the legs back onto the ground. As the pivotal motion of each wheel support member and the respective linking bracket on the long shaft are constrained to different ones of two perpendicular planes, the connection between them must allow not only pivotal motion between the linking bracket and the side flange of the wheel support member, but an additional degree "play" or "give". In the example of using a bolt as a pivot pin to connect these elements, this "play" can be provided by using bolt holes of slightly greater diameter than the bolt to allow the bolt to tilt within the holes into and out of axial alignment therewith the hole and not fully tightening the nut, for example a nylon nut. The resulting permission of tilt and provision of extra length pivot shaft length allow the relative movement between the wheel support member and the respective linking bracket without excessive stress on the wheel system components.

Figure 18:
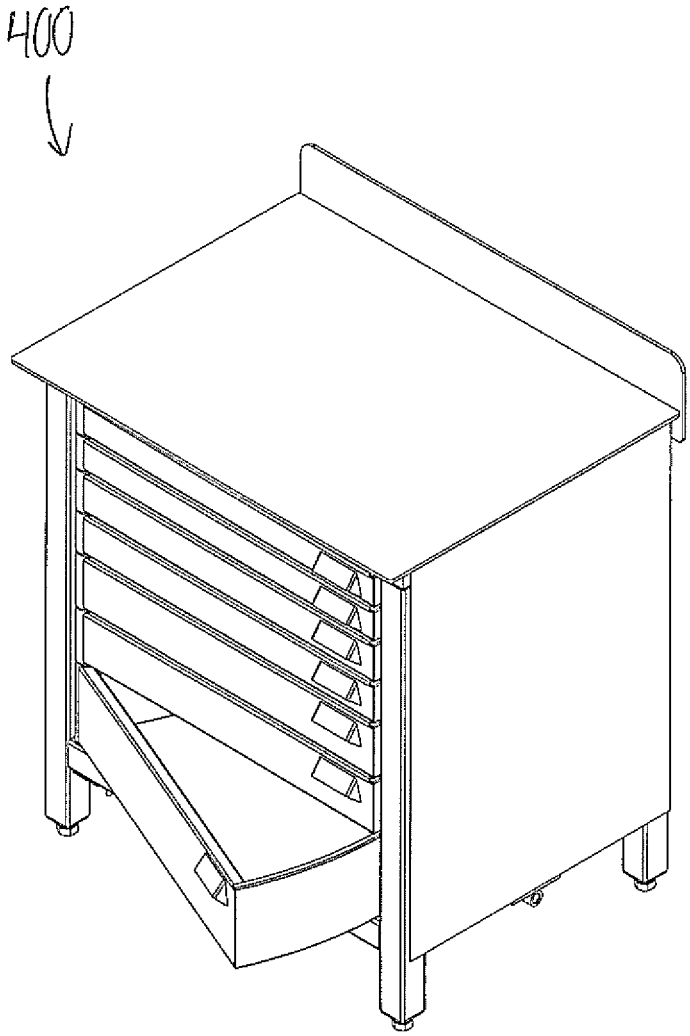
FIG. 18 is a top, front, right side isometric view of a tool chest work bench according to a fifth embodiment of the present invention, with wheels thereof omitted.

FIG. 18 shows another tool chest work bench combination unit 400 according to a fifth embodiment of the present invention, which differs from the fifth embodiment in that the only a single column of drawers is included and accordingly only a single linkage is driven by the rotation of the key cylinder to control locking of all the drawers. The same drawer shape is used as in one of the drawer columns of the fourth embodiment so that the front face of each drawer extends substantially the full width of the front the housing, while the curving of the side of the drawer opposite the pivot avoids contact with the side wall of the housing. The same curving of one side of each drawer could be used in a two drawer column embodiment in which the one or both of the drawer columns are pivoted adjacent the center of the chest.

As shown in the figures, the unit may include height adjustable feet in the form of bolt-like feet having threaded shafts engaging with matingly threaded holes in the bottom ends of the legs to allow fine tuning of individual leg heights by telescoping the shaft of the foot further out of and nesting the shaft further into a hollow interior of the leg through rotation of the foot in opposite directions for leveling of the unit when positioned on an uneven surface. As shown in some of the figures, radial holes in the hollow cylindrical sleeves of the drawer structures may be included for use a grease passages through which lubricant can be delivered to minimize friction and wear in the pivoting of the drawers.

The frames and drawers of tool chests of the present invention are preferably made of all metal constructions for heavy duty strength, but it will be appreciated that aspects of the present invention may also be used in storage chests for lighter duty applications where other materials may provide suitable strength. Furthermore, it will be appreciated that features described for the illustrated embodiments in terms of left and right sides are not limited to installation on one particular side versus another. Embodiments with as little as one drawer could benefit from aspects of the invention presented herein and embodiments with different drawers within a column hinged on different sides could also be produced. Also, the present invention should not be limited to the particular housing and drawer shapes disclosed herein, as alternate shape configurations are certainly possible while retaining novel features disclosed and claimed herein. For example, the diverging side walls of the corner unit of the first embodiment could be employed without having them meet at a rear corner, as a narrow back wall could instead be employed on the housing and drawers. Furthermore, have side walls that diverge or at least a side wall opposite the hinged side that angles away from the hinged side can be used to accommodate motion of the distal rear corner of a drawer that doesn't necessarily conform to the same shape denoted by the housing walls.

Although the illustrated embodiments feature housings enclosed on all but one side by exterior walls for maximum security, it will be appreciated that other embodiments employing the locking mechanism disclosed herein between an exterior rear wall and drawers may rely on the side walls of the drawers to form one or more side walls of the overall chest when closed, much like the front walls of the drawers close off the open front face of the housings of the illustrated embodiments. Also, the wheel deployment may be used with tool chests not employing the swivel-type drawers or locking mechanisms disclosed herein, and even on tool chests that don't specifically have a counter-type or other workbench-suitable top surface. It will also be appreciated that the locking mechanisms may employ an actuator other than a key cylinder, for example by using electronically controlled actuators operable to effect the rotational motion to pivot the blocking member.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A storage chest comprising:

a frame comprising a base, a frame wall structure projecting upward from the base, a cover disposed atop the frame wall structure and an open face left between the base and the cover between sections of the frame wall structure; and a plurality of metal drawers carried on the frame between the base and the cover thereof, each drawer comprising a bottom drawer wall and a plurality of upright drawer walls projecting upward from the bottom drawer wall toward an opposing top end of the drawer and forming boundaries of a storage space area atop the bottom drawer wall; and each drawer having a pivotal connection to the base of the frame, by which the drawer is pivotable about an upright axis projecting upward from the base between a closed position, in which a front face of the drawer defined by a front drawer wall of the upright drawer walls aligns with the open face of the frame to situate the storage space area of the drawer behind the open face of the frame between sections of the frame wall structure, and an open position, in which the storage space of the drawer is situated at least partly in front of the open face of the frame outward from between the sections of the frame wall structure;

wherein the pivotal connection of each drawer comprises an upright sleeve fixed to the drawer with a wall of the sleeve closing around an upright shaft that extends along a bore of the sleeve to define the upright axis about which the drawer is pivotable, the upright sleeve has a lubrication passage in the form of a hole extending radially into the bore through the wall of the sleeve to enable introduction of lubricant between the wall of the sleeve and the upright shaft received therein, a top end of the sleeve of each drawer is flush with a top end of the upright drawer walls of said drawer, and a bottom end of the sleeve of each drawer is flush with a bottom end of the front face of each drawer; and wherein the plurality of drawers includes a column of drawers disposed one over another to define at least one pair of vertically adjacent drawers that reside in the open face of the frame when each in the closed position, the sleeves of the column of drawers closing around the same shaft and a respective thin flat washer disposed around the shaft at a position between the sleeves of each pair of vertically adjacent drawers in said column to define an only spacer between said vertically adjacent drawers of each pair; wherein the front drawer wall of each drawer is defined by a member of channel-shaped vertical cross section having a vertically oriented center portion and horizontally oriented upper and lower portions projecting therefrom; wherein, for each drawer, the vertically oriented center portion of the channel-shaped vertical cross-section defines the front face of the drawer, and the horizontally oriented portions of the channel-shaped vertical cross-section define top and bottom flanges of the front wall.

2. The storage chest according to claim 1 wherein each washer has a friction reducing coating thereon.

3. The storage chest according to claim 1 comprising an additional thin flat washer disposed between a lowermost drawer in the column and the base of the frame, the lowermost drawer and the base being separated only by said flat washer.

4. The storage chest according to claim 1 wherein the lubrication passage of the sleeve of each drawer passes through the wall of said sleeve from a side thereof that faces outwardly away from the storage area of said drawer.

5. The storage chest of claim 4 wherein the sleeve of each drawer is located at the open face of the frame, and the lubrication passage passes through the wall of said sleeve from a side thereof that faces outwardly from the open face of the frame when the drawer is in the closed position.

6. The storage chest according to claim 1 comprising:

a set of legs depending downward from the base a pair of coaxial shafts that are pivotally secured to the frame adjacent opposite peripheral portions thereof below the at least one drawer and proximate the base of the frame for pivoting of said pair of coaxial shafts about a longitudinal pivot axis that extends across the frame and centrally and longitudinally through the pair of coaxial shafts;

movable wheel supports supported on the frame below the at least one drawer and proximate the base of the frame, the movable wheel supports each being pivotal about a respective transverse pivot axis that lies crosswise to the longitudinal pivot axis to allow upward and downward movement of a free end of the wheel support at a distance from the respective transverse pivot axis along the longitudinal pivot axis;

a set of wheels—mounted on the movable wheel supports adjacent the free ends thereof;

a longer shaft lying parallel to the pair of coaxial shafts and being eccentrically fixed thereto in order to connect said pair of coaxial shafts together for shared rotation of said coaxial shafts about the longitudinal pivot axis and to revolve the longer shaft around the longitudinal pivot axis under said shared rotation of the coaxial shafts; and links each pivotally connected at opposite ends thereof to the longer shaft and a respective one of the movable wheel supports at a respective position along the longitudinal pivot axis between the transverse pivot axis of the respective movable wheel support and the free end thereof such that pivoting of the pair of coaxial shafts in opposite directions to move the longer shaft into and out of a predetermined angular position about the longitudinal pivot axis moves the free ends of the movable wheel supports downward and upward respectively to move the wheels into and out of deployed positions in which the wheels extend further downward from the base than the legs in order to rollably support the storage chest on the ground.

7. The storage chest according to claim 1 wherein the channel-shaped vertical cross section of the front wall of each drawer is C-shaped.

8. A storage chest comprising:

a frame comprising a base, an upright structure projecting upward from the base, a cover disposed atop the upright structure and an open face left between the base and the cover;

at least one drawer carried on the frame between the base and the cover thereof, each drawer comprising a bottom drawer wall and a plurality of upright drawer walls projecting upward from the bottom drawer wall toward an opposing top end of the drawer and forming boundaries of a storage space area atop the bottom drawer wall; and each drawer being movably supported on the base of the frame and movable between a closed position, in which a front face of the drawer defined by a front drawer wall of the upright drawer walls aligns with the open face of the frame to situate the storage space area of the drawer inside the frame behind the open face thereof, and an open position, in which the storage space of the drawer is situated at least partly outside the frame in front of the open face thereof;

a set of legs depending downward from the base of the frame;

a pair of coaxial shafts that are pivotally secured to the frame adjacent opposite peripheral portions thereof below the at least one drawer and proximate the base of the frame for pivoting of said pair of coaxial shafts about a longitudinal pivot axis that extends across the frame and centrally and longitudinally through the pair of coaxial shafts;

movable wheel supports supported on the frame below the at least one drawer and proximate the base of the frame, the movable wheel supports each being pivotal about a respective transverse pivot axis that lies crosswise to the longitudinal pivot axis to allow upward and downward movement of a free end of the wheel support at a distance from the respective transverse pivot axis along the longitudinal pivot axis;

a set of wheels mounted on the movable wheel supports adjacent the free ends thereof;

a longer shaft lying parallel to the pair of coaxial shafts and being eccentrically fixed thereto in order to connect said pair of coaxial shafts together for shared rotation of said coaxial shafts about the longitudinal pivot axis and to revolve the longer shaft around the longitudinal pivot axis under said shared rotation of the coaxial shafts; and links each pivotally connected at opposite ends thereof to the longer shaft and a respective one of the movable wheel supports at a respective position along the longitudinal pivot axis between the transverse pivot axis of the respective movable wheel support and the free end thereof such that pivoting of the pair of coaxial shafts in opposite directions to move the longer shaft into and out of a predetermined angular position about the longitudinal pivot axis moves the free ends of the movable wheel supports downward and upward respectively to move the wheels into and out of deployed positions in which the wheels extend further downward from the base than the legs in order to rollably support the storage chest on the ground.

9. The storage chest according to claim 8 wherein at least one of the pair of coaxial shafts projects outwardly from the frame and has a foot pedal fixed to the shaft to project in two directions therefrom at a position outward from the frame for foot-operated user control of pivoting of the pair of coaxial shafts.

10. The storage chest according to claim 9 wherein the wheels are automatically locked in the deployed position by a weight of the cabinet under an over-center shifting of said weight about the longitudinal pivot axis under movement of the longer shaft to the predetermined angular position.

11. The storage chest according to claim 10 comprising a stop at a fixed position on the frame that is cooperative with a feature on one of the pair of coaxial shafts to block further pivoting of the pair of coaxial shafts after having reached a point where the longer shaft has moved over center about the longitudinal pivot axis and reached the predetermined angular position, which is located between under and over center positions about said longitudinal pivot axis.

* * * * *